US006051771A

United States Patent [19]

Iizuka

[11] Patent Number: 6,051,771

[45] Date of Patent: Apr. 18, 2000

[54] APPARATUS AND METHOD FOR GENERATING ARPEGGIO NOTES BASED ON A PLURALITY OF ARPEGGIO PATTERNS AND MODIFIED ARPEGGIO PATTERNS

[75] Inventor: Akira Iizuka, Hamamatsu, Japan

[73] Assignee: Yamaha Corporation, Japan

[21] Appl. No.: 09/176,645

[22] Filed: Oct. 21, 1998

[30] Foreign Application Priority Data

Oct. 22, 1997 [JP] Japan ..... 9-290010

[51] Int. Cl.[7] ..... G10H 1/36

[52] U.S. Cl. ..... 84/622; 84/638; 84/716

[58] Field of Search ..... 84/622–625, 638, 84/659–661, 692–700, 716, DIG. 12, 613, 637, 650, 669, 715, DIG. 22

[56] References Cited

U.S. PATENT DOCUMENTS

| | | | |
|---|---|---|---|
| 4,271,741 | 6/1981 | Hoskinson et al. | 84/1.03 |
| 4,444,081 | 4/1984 | Jones et al. | 84/1.03 |
| 4,624,170 | 11/1986 | Ohno et al. | 84/622 |
| 4,864,908 | 9/1989 | Kino | 84/638 |
| 5,495,073 | 2/1996 | Fujishima et al. | 84/609 |
| 5,714,705 | 2/1998 | Kishimoto et al. | 84/651 |

FOREIGN PATENT DOCUMENTS

| | | |
|---|---|---|
| 2-131292 | 5/1990 | Japan . |
| 2129598A | 5/1984 | United Kingdom . |

*Primary Examiner*—Stanley J. Witkowski
*Attorney, Agent, or Firm*—Rossi & Associates

[57] ABSTRACT

An arpeggio notes generating apparatus includes a ROM which stores data defining a plurality of arpeggio patterns and a plurality of groove patterns. An arpeggio pattern is composed of a succession of chord constituent notes to be generated at respectively corresponding timings. A set of data for each note include data to identify the note generation timing, the key number, the duration and the velocity value. A groove pattern is composed of a succession of note generation modifier data sets, and each set is for each arpeggio note and includes data to define amounts of modification to be applied to the data for each note generation. Two arpeggio patterns and two groove patterns are selected in correspondence. The note generation timing, the durations and the velocity values in each arpeggio pattern are individually modified according to the corresponding data in each groove pattern to provide two modified arpeggio patterns. The note numbers of the keys depressed in the arpeggio key range are allotted to the key numbers. The modified arpeggio patterns are read out by interruption processing, and determine each note generation to impart groovy sensation in the musical performance.

17 Claims, 13 Drawing Sheets

ARPEGGIO SET PROCESSING

DEPRESSED/RELEASED KEY PROCESSING

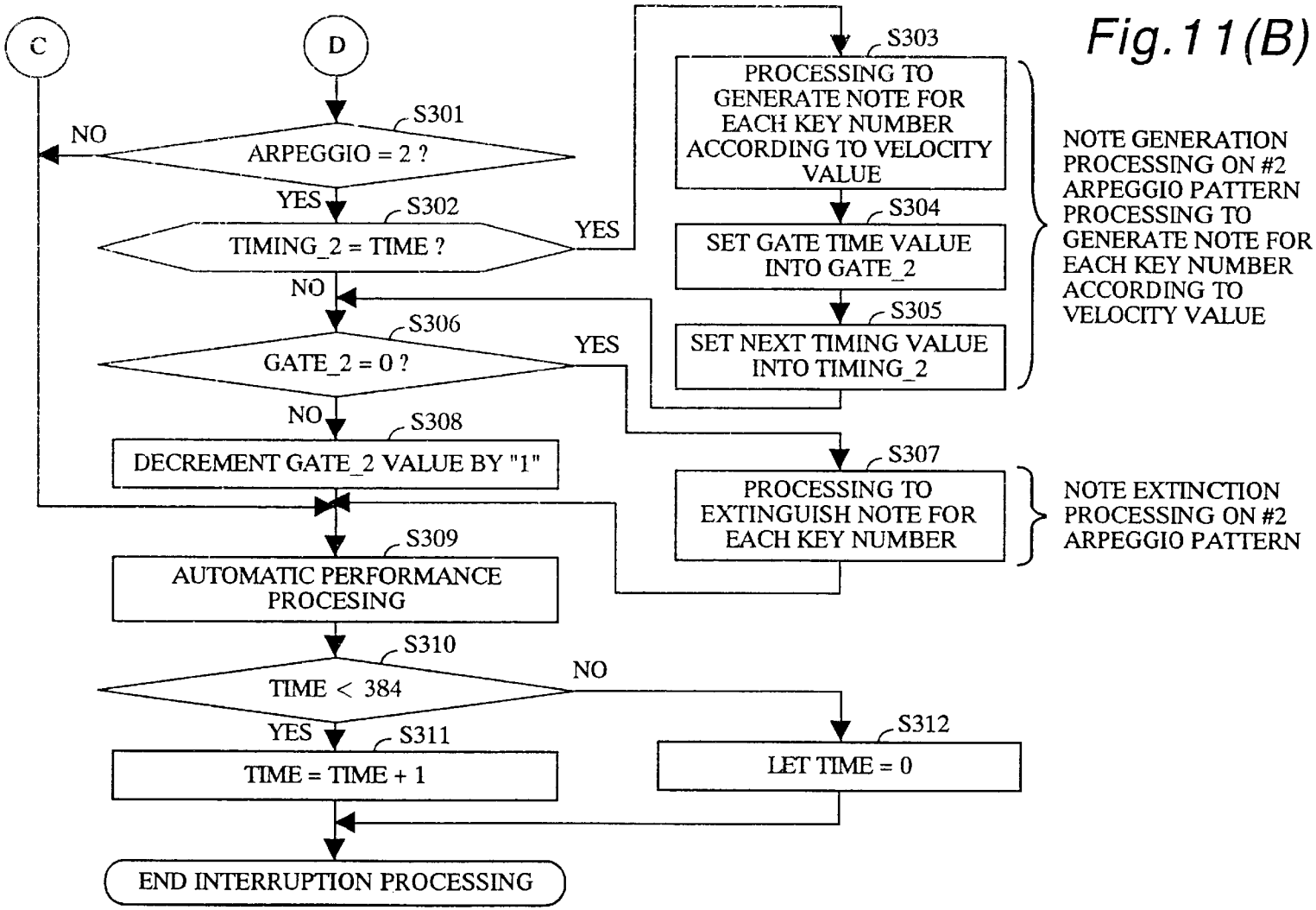
Fig. 11(B)
NOTE GENERATION PROCESSING ON #2 ARPEGGIO PATTERN
PROCESSING TO GENERATE NOTE FOR EACH KEY NUMBER ACCORDING TO VELOCITY VALUE
NOTE EXTINCTION PROCESSING ON #2 ARPEGGIO PATTERN
D
C
S301
ARPEGGIO = 2 ?
YES
NO
S302
TIMING_2 = TIME ?
YES
NO
S303
PROCESSING TO GENERATE NOTE FOR EACH KEY NUMBER ACCORDING TO VELOCITY VALUE
S304
SET GATE TIME VALUE INTO GATE_2
S305
SET NEXT TIMING VALUE INTO TIMING_2
S306
GATE_2 = 0 ?
YES
NO
S307
PROCESSING TO EXTINGUISH NOTE FOR EACH KEY NUMBER
S308
DECREMENT GATE_2 VALUE BY "1"
S309
AUTOMATIC PERFORMANCE PROCESING
S310
TIME < 384
YES
NO
S311
TIME = TIME + 1
S312
LET TIME = 0
END INTERRUPTION PROCESSING

APPARATUS AND METHOD FOR GENERATING ARPEGGIO NOTES BASED ON A PLURALITY OF ARPEGGIO PATTERNS AND MODIFIED ARPEGGIO PATTERNS

BACKGROUND OF THE INVENTION

1. Field of the Invention

The present invention relates to an arpeggio performing apparatus and method which automatically conducts arpeggio performance using the notes as determined based on the note pitch information inputted from the keyboard or the like devices and on the arpeggio pattern defining the sounding timings, etc. of the notes to constitute an arpeggio (broken chord) performance, and relates further to a computer readable medium containing program instructions for operating the computer system to realize and control arpeggio performances.

2. Description of the Prior Art

Among conventional electronic musical instruments, there are such types of instruments that conduct arpeggio performances as one form of automatic musical accompaniments in response to simple operations by the player (user) of the instrument. Such a type of instrument comprises, for example, stored data sets defining a plurality of arpeggio patterns and associated data processors, and operates in such a way that the user selects a desired arpeggio pattern and depresses a key or keys in the predetermined region in the keyboard to designate a tonality key and a mode for arpeggio performance, then a plurality of note numbers are created in accordance with the selected arpeggio pattern based on the depressed key(s), and notes identified by such note numbers are sounded sequentially in the predetermined order. In other words, by simply depressing keys simultaneously or otherwise in a predetermined key range, a complicated arpeggio performance will be realized, without playing an arpeggio fingering on the keyboard.

An arpeggio pattern is stored in the form of a data set which defines the note sounding timing, the note length (duration), the tone volume, the octave shift amount, etc. for each of the arpeggio constituting notes. The data set may be preset in the instrument, or may be set by the user, and any desired one will be selected for use from among a plurality of such patterns.

With a conventional electronic musical instrument having an automatic arpeggio performance faculty, however, only one arpeggio pattern can be selected beforehand for the musical performance, and consequently only one type of arpeggio effects can be exhibited (utilized) during the musical performance on the instrument, which may leads to a kind of monotonous music performance.

SUMMARY OF THE INVENTION

It is, therefore, a primary object of the present invention to provide an automatic arpeggio performance apparatus capable of enhancing the musical expressivity in sounding arpeggio notes, by improving the data processing for the arpeggio function.

According to the present invention, the object is accomplished by providing an apparatus or a method for generating arpeggio notes, or a computer readable medium containing program instructions executable by a computer system to configure such an apparatus, which stores a plurality of arpeggio patterns each of which defines at least generation timings of the notes to constitute an arpeggio performance, permits the user to select at least two arpeggio patterns from among the stored arpeggio patterns and also to input note pitch information which designates pitches of arpeggio constituent notes, and generates notes for arpeggio performance based on the selected arpeggio patterns and the inputted note pitch information.

According to the present invention, the object is also accomplished by providing an apparatus or a method for generating arpeggio notes, or a computer readable medium containing program instructions executable by a computer system to configure such an apparatus, which stores at least one arpeggio pattern each of which defines at least generation timings of the notes to constitute an arpeggio performance, further stores a plurality of groove patterns each of which includes modification data defining at least one modification amount by which at least the timing of note generation is to be modified, permits the user to select at least one arpeggio pattern and at least one groove pattern from among the stored patterns, modifies the selected arpeggio pattern using the selected groove pattern to make a modified arpeggio pattern, permits the user to input note pitch information which designates pitches of arpeggio constituent notes, and generates notes for arpeggio performance based on the modified arpeggio pattern and the inputted note pitch information.

According to an aspect of the present invention, an apparatus for generating arpeggio notes comprises: a note pitch input device inputting note pitch information which designates pitches of arpeggio constituent notes; an arpeggio pattern storage device storing a plurality of arpeggio patterns each of which defines at least generation timings of the arpeggio constituent notes; an arpeggio pattern selection device for selecting at least two arpeggio patterns from the arpeggio pattern storage device; and a tone generator device for generating a plurality of notes for arpeggio performance based on the inputted note pitch information and the selected at least two arpeggio patterns. The arpeggio performance according to at least two arpeggio patterns simultaneously will enhance a variety in the arpeggio performance.

According to another aspect of the present invention, an apparatus for generating arpeggio notes comprises: a note pitch input device inputting note pitch information which designates pitches of arpeggio constituent notes; an arpeggio pattern storage device storing at least one arpeggio pattern each of which defines at least generation timings of the arpeggio constituent notes; a groove pattern storage device storing a plurality of groove patterns each of which includes modification data defining at least one modification amount by which at least the timing of note generation is to be modified; a groove pattern selection device for selecting at least one groove pattern from the groove pattern storage device; an arpeggio pattern modification device for modifying at least the timing of note generation of the arpeggio pattern stored in the arpeggio pattern storage device using the modification data in the selected at least one groove pattern; and a tone generator device for generating a plurality of notes for arpeggio performance based on the inputted note pitch information and the modified at least one arpeggio pattern. The arpeggio performance according to the timing-modified arpeggio pattern will provide a rhythmically expressive arpeggio performance free of monotonousness.

According to further aspect of the present invention, an apparatus for generating arpeggio notes comprises: a note pitch input device inputting note pitch information which designates pitches of arpeggio constituent notes; an arpeggio pattern storage device storing at least one arpeggio patterns each of which defines at least generation timings and a tone color of the arpeggio constituent notes; and a tone generator device for generating a plurality of notes for arpeggio performance based on the inputted note pitch information and at the timings and in a tone color defined by the stored at least one arpeggio pattern. The arpeggio patterns can be prepared such that each arpeggio pattern is given a unique tone color, and thus the arpeggio performance will be more pleasing in terms of tone color of the generated notes. When plural arpeggio patterns are used simultaneously, each pattern can be recognized independently by means of differences in tone color.

According to still further aspect of the present invention, an apparatus for generating arpeggio notes comprises: a note pitch input device inputting note pitch information which designates pitches of arpeggio constituent notes; an arpeggio pattern storage device storing track arpeggio patterns including a plurality of track data set each of which defines at least generation timings and a tone color of the arpeggio constituent notes; and a tone generator device for generating a plurality of notes for arpeggio performance based on the inputted note pitch information and at the timings and in a tone color defined by the stored track arpeggio patterns. The track data architecture provides concurrent progression of a plurality of arpeggio patterns in parallel, and the user can enjoy even a complicated arpeggio performance with full of variety in adequate tone colors.

BRIEF DESCRIPTION OF THE DRAWINGS

For a better understanding of the present invention, and to show how the same may be practiced and will work, reference will now be made, by way of example, to the accompanying drawings, in which.

DESCRIPTION OF THE PREFERRED EMBODIMENTS

Figure 1:
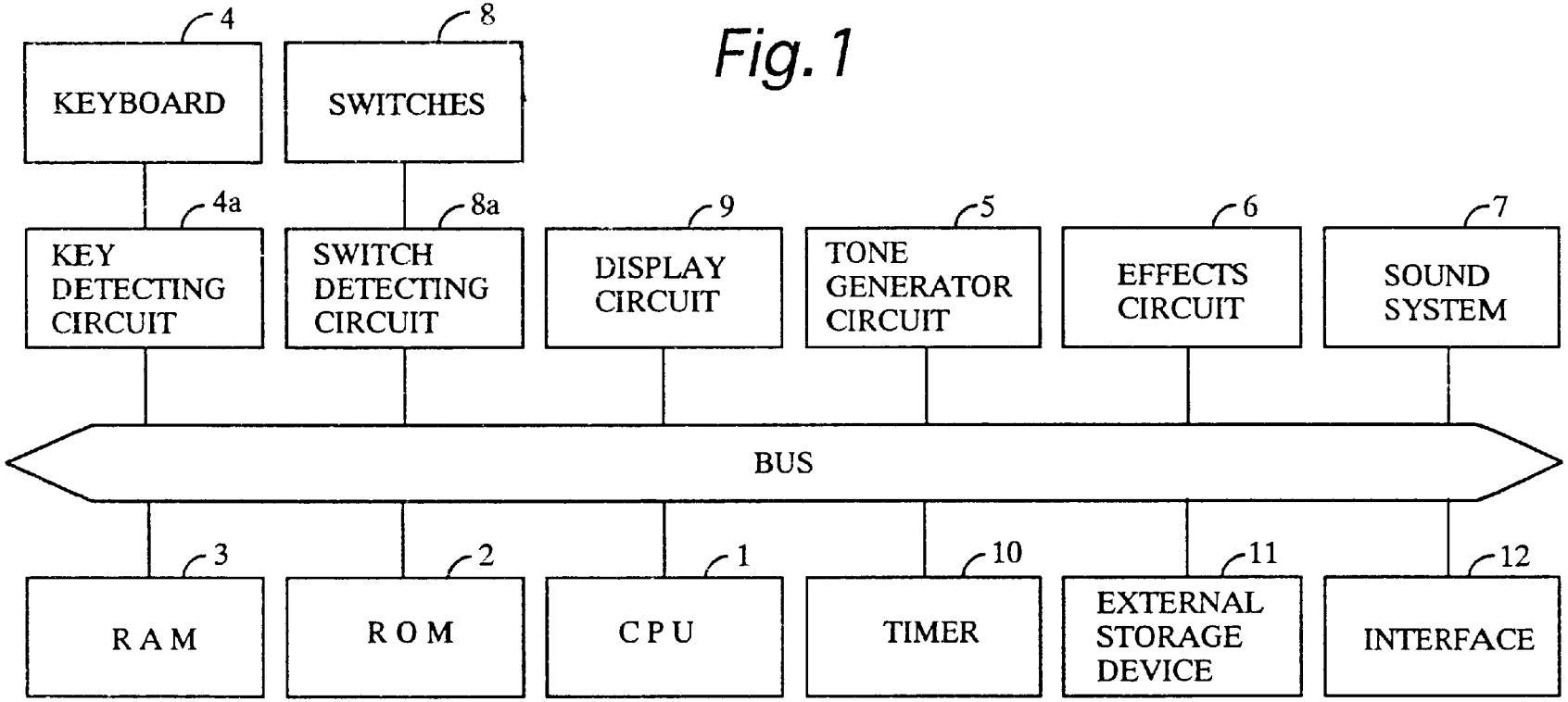
FIG. 1 is a block diagram showing a general hardware construction of an embodiment of an electronic musical instrument to which is applied an arpeggio performing apparatus according to the present invention.

Illustrated in FIG. 1 of the drawings is a general block diagram of an embodiment of an electronic musical instrument incorporating an automatic arpeggio performance apparatus according to the present invention. CPU 1 controls the overall operation of the electronic musical instrument according to control programs stored in a ROM 2 and using working areas in a RAM 3. During musical performance on a keyboard 4, the CPU 1 gets note numbers, key-on signals, key-off signals etc. from the keyboard 4 via a key detecting circuit 4*a*, and conducts note generation processing and note extinction processing by instructing note numbers, velocity signals, note-on signals and note-off signals to a tone generator circuit 5. The tone generator circuit 5 generates a tone signal in accordance with the note number, the note-on signal and the velocity signal in a tone color determined by the tone color setting. The tone signals generated at the tone generator 5 are imparted with desired various tone effects at an effects circuit 6 and are emitted as audible sounds by a sound system 7. When the CPU gets a note number signal and a note-off signal, it attenuates or stops the tone generation to extinguish the sounding.

In the arpeggio performance mode, an arbitrarily demarcated key range in the keyboard can be set by the user to be the arpeggio key range, in which the depressed keys are detected in the form of note numbers (note pitch data), which in turn are used to define the pitches of arpeggio constituent notes. Based on the note numbers detected within the arpeggio key range and the arpeggio patterns to be described later, the CPU 1 sets the note numbers, the velocity signals, and note-on/note-off signals for the tone generator circuit 5 to generate and extinguish the sounding of the arpeggio performance tones. Note numbers detected outside the arpeggio key range are used for the tone generation of notes in accordance with an ordinary keyboard performance. The arpeggio key range can be set by appointing a split point in the keyboard 4 to divide the keyboard 4 into two regions and to nominate the lower side therefrom as an arpeggio key range, or by appointing a lower and a higher end to directly nominate the arpeggio key range.

The CPU 1 also gets input data from various switches 4 arranged in a control panel via a switch detecting circuit 8*a*, and conducts various processings in accordance with the manipulations of the switches 8, including switching over to the arpeggio performance mode. Further, other than the switches 8, the so-called GUI (graphical user interface) utilizing an LCD panel in a display circuit, etc. may also be employed for the user's input manipulation such as selection of arpeggio patterns.

The CPU 1 also delivers information on input-designated tempo to a timer 10, which generates a tempo clock signal for the designated tempo. The CPU 1 conducts interruption processing at each clock signal pulse, and conducts the processing for the arpeggio note generation. In the herein described embodiment, the tempo clock signal includes 96 clock pulses for the duration of a quarter note and 384 clock pulses for the span of one measure.

An external storage device 11 may be a hard disk drive, a floppy disk drive, a CD-ROM drive, an optical magnetic disk drive, or else, and may be used for storing and providing various data such as the arpeggio patterns. An interface 12 is a communication interface connected to a MIDI device or an external computer, and serves to permit the apparatus communicate with an external MIDI device or an external computer to transmit and receive various data including arpeggio patterns.

Figure 2:
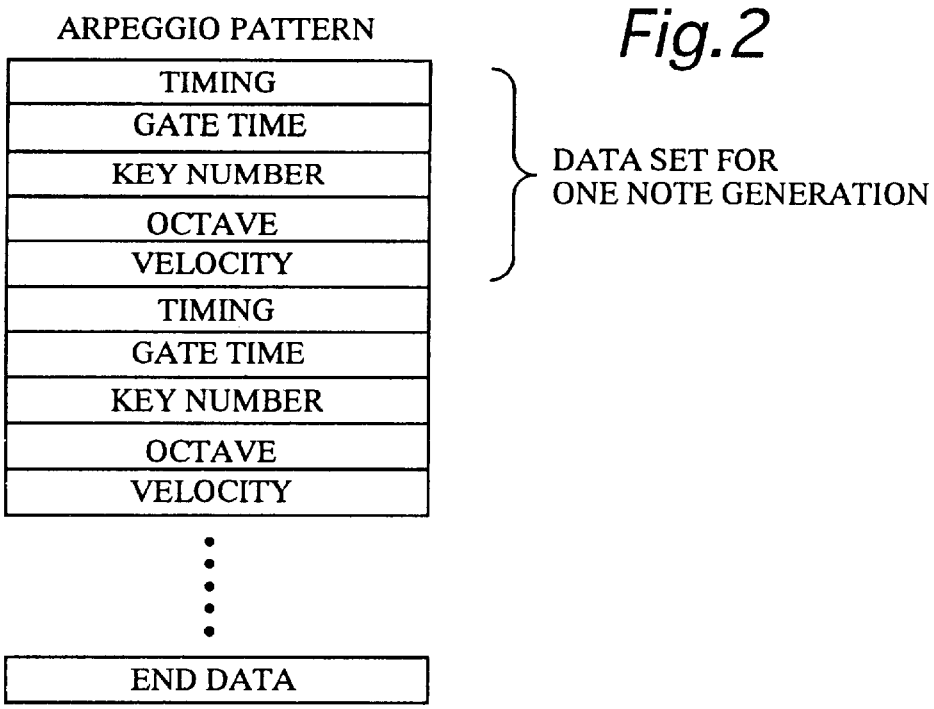
FIG. 2 shows a data format of an arpeggio pattern used in the embodiment of the present invention.

FIG. 2 shows a data format of an arpeggio pattern used in this embodiment. The arpeggio pattern consists of a number of data sets respectively corresponding to the notes constituting the arpeggio performance and "end data" for one measure, in which one data set includes five data pieces, i.e. "timing" data, "gate time" data, "key number" data, "octave" data and "velocity" data for defining the generation of one note. The "timing" is data representing a clock value which indicates the starting time point of a tone generation, the "gate time" is data representing a clock value which indicates the time length from the key-on to the key-off of the tone generation.

The "key number" is data identifying the pitch of a note to be generated. In the RAM 3 there are provided registers nominated as the "key numbers", and into these "key number" registers are stored the note numbers detected in the arpeggio key range such that each note number is allotted to each of "key number" data according to a predetermined rule. And in the arpeggio tone generation processing, the note numbers allotted to the "key numbers" in the arpeggio pattern are read out from the registers and are used to determine the note pitches of the tones for arpeggio performance. These note numbers themselves, however, are not necessarily be the absolute note pitches of the tones to be actually generated, as octave shifts will be introduced individually.

Specifically, for example, where the number of detectable keys within the arpeggio key range is set to be four, the "key numbers" are data respectively of values "1" through "4", and each of these values is allotted to a predetermined data set for one of tone generations according to the pitch travel pattern for the arpeggio. The allotment rule in this embodiment is that the note numbers detected in the arpeggio key range in the order from the lowest note and upward are successively allotted to the "key numbers" in the order from the lowest value and upward.

The "octave" is data indicating the amount of octave shift for the note pitch designated by the key depressed in the arpeggio key range. For example, when the note number assigned to the "key number" in a data set for one note is "C3" and if the stored "octave" value is "0", a note is generated in the pitch of C3 itself without an octave shift at the timing of the note C3 generation, whereas if the stored "octave" value is "+1", a note is generated in the pitch of C4 with an octave shift by the amount of one octave upward at the timing of the note C3 generation.

The "velocity " is data representing a velocity value for the tone to be generated. This is the data to be used for controlling the tone volume, etc. in the generation of tones, and is so named because it corresponds to the velocity of a key depression in the case of a piano or other touch responsive keyboard musical instruments. While this data is included in the arpeggio pattern as previously provided, but this data may be ignored in tone generation in the case of an electronic musical instrument or an apparatus having a touch responsive keyboard which is capable of detecting the velocity value of each key manipulation, and the velocity values data respective key depressions may be used instead.

An actual arpeggio note generation will be hereby described based on an example of the arpeggio pattern listed in the following Table 1. In the table, "timing" denotes the timing of tone generation, "gate" denotes the gate time, "key" denotes the key number, "oct" denotes the octave, and "vel" denotes the velocity. The length of the arpeggio pattern in this example is one measure (i.e. 384 clocks), and the notes are generated in the manner depicted in FIG. 7(A) to be explained later.

TABLE 1

| timing | gate | key | oct | vel |
|---|---|---|---|---|
| 000 | 48 | 1 | +0 | 30 |
| 120 | 24 | 1 | +1 | 20 |
| 192 | 48 | 2 | +0 | 30 |
| 312 | 24 | 2 | +1 | 30 |

Supposed the keys having note numbers B3, C3, E3 and G3 are depressed in the arpeggio key range, the note number C3 (the lowest note among the four) is assigned the key number 1, the note number E3 (the second lowest note among the four) is assigned to the key number 2, the note number G3 to the key number 3, and the note number B3 to the key number 4 (in an ascending order from the lowest). As the key numbers designated in the table are only "1" and "2", this arpeggio pattern is to generate notes determined by the note numbers of the lowest two keys among the depressed keys in the arpeggio key range.

At the first and the second beat in Table 1, key=1, and therefore the note pitch for these beats are determined by the note number C3 which is allotted to the key number 1. As the first beat data set includes the "oct" data of "+0", the note to be generated at the first beat will be C3 without an octave shift. But the note to be generated at the second beat will be C4, as the "Oct" data in the second beat data is "+1". At the third and the fourth beat in Table 1, key=1, and therefore the note pitch for these beats are determined by the note number E3 which is allotted to the key number 2. As the third beat data set includes the "oct" data of "+0", the note to be generated at the third beat will be E3 without an octave shift. But the note to be generated at the fourth beat will be E4, as the "oct" data in the fourth beat data is "+1".

As described above, the note numbers of the keys depressed in the arpeggio key range are referred to by the key numbers, and the notes will be generated based on the note numbers in the arpeggio pattern with or without an octave shift depending on the value of the "oct" data. In other words, the note numbers of the depressed keys are note pitch information determining the pitches of the arpeggio constituent notes with the help of the octave data.

An electronic musical instrument of this embodiment further has a grooving faculty for imparting delicate groove sensation (kind of nuance felt in individual player's performances) to the performance data formed by the user, in addition to the function of arpeggio notes generation for automatic arpeggio performance. An arpeggio pattern itself is a serial alignment of tone generation timings, and therefore is of a similar format to the ordinary musical performance data. Thus, the arpeggio pattern can be modified to have delicate characteristic feeling by means of the groove function imparting processing.

Groove Function

Hereinbelow will be made an explanation about the groove function. The groove function is a function of modifying the "timing" data, the "gate time" data and the "velocity" data among the note generation determining elements in the arpeggio pattern to fit, for instance, the performance style of music (such as swing, beat rock and other musical genres) by the use of groove pattern data as shown in FIG. 3 to make a modified arpeggio pattern.

On the other hand, there has been known and conventionally utilized a quantization function in the field of electronic musical data processing, in order to correct the respective tone generation timings of the performance data to accurate time points in terms of beats (rhythm), as the inputted performance data from an actual keyboard performance are apt to involve some offsets (deviation) from the correct beat timings of tone generation. In this embodiment, the groove function operates in such a way that the arpeggio pattern is first processed by quantization and then the quantized arpeggio pattern is subject to the modification by the groove function. The quantization function may be substantially canceled by means of "user-set groove function values" as will be described herein later.

Figure 3:
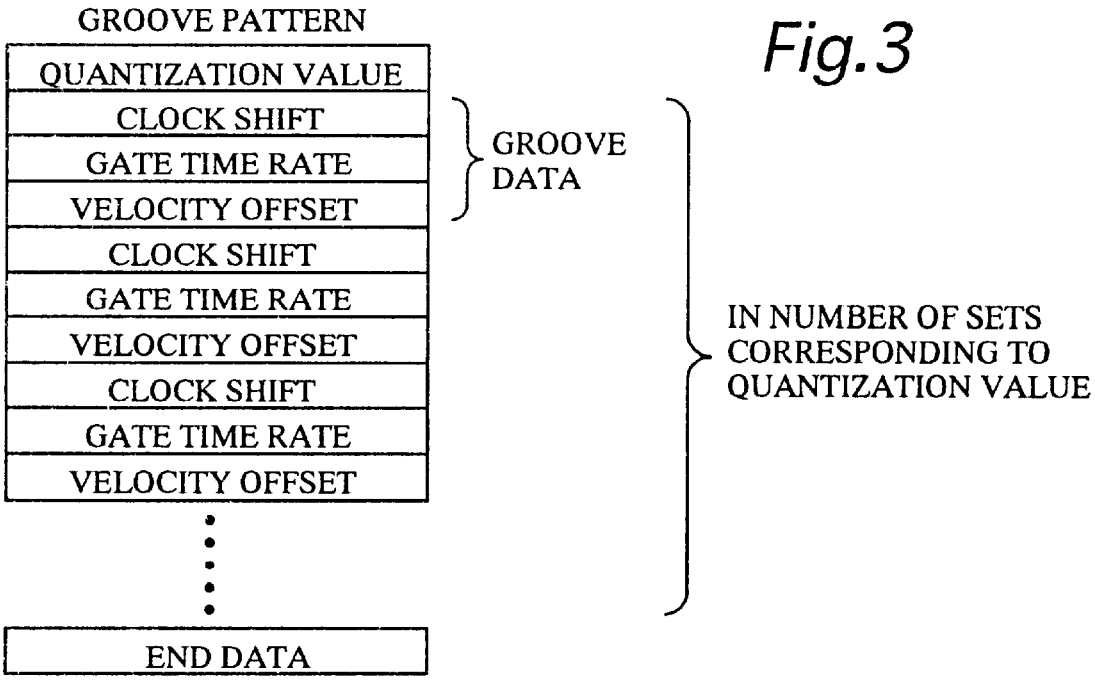
FIG. 3 shows a data format of a groove pattern used in the embodiment of the present invention.

FIG. 3 shows a data format of a groove pattern used in this embodiment. The arpeggio pattern consists of quantization value data, a number of groove data sets and "end data". The "quantization value" is data specifying the basic beat interval (temporal resolution) for quantization processing. The basic beat interval is expressed in terms of note duration such as a 16th note, an 8th note and a quarter note. The groove data sets are prepared in the number corresponding to the quantization value. For example, in the case of a groove pattern for one measure of 4/4 meter, the number of such data sets is sixteen under the quantization value of a 16th note, eight under the quantization value of an 8th note, and four under the quantization value of a quarter note. A basic unit for processing quantization in reference to the positions of the resolution beats specified by the "quantization value" is termed a "grid".

One set of groove data comprises "clock shift " data which represents the amount of shifting the note generation timing before (−) or after (+) in the number of clocks, "gate time rate" data which represents the rate of changing the gate time (duration) of the note in the multiplication factor, and "velocity offset" data which represents the value of increasing (+) or decreasing (−) the velocity value of the note to be generated.

This embodiment further comprises user-set groove function values (which is set by the user) for adjusting the sensitivity (degree) of the groove effect including quantization. These user-set groove function values include a "quantization strength" value which represents the degree of effecting quantization, a "groove timing" value which represents the degree of effecting the clock shift value included in the groove pattern onto the notes to be generated, a "groove gate time" value which represents the degree of effecting the gate time rate in the groove pattern onto the notes to be generated, and a "groove velocity" value which represents the degree of effecting the velocity offset value included in the groove pattern onto the notes to be generated.

Figure 6:
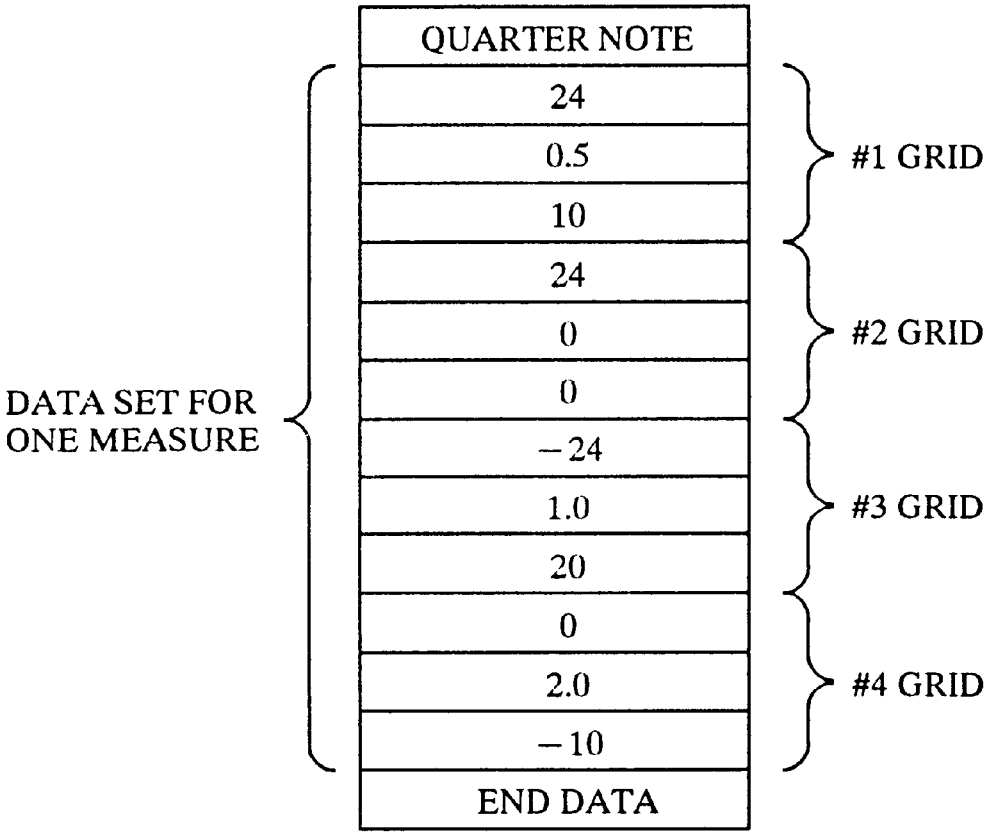
FIG. 6 is a data chart showing an example of the groove pattern used in the embodiment.

FIG. 6 is a data chart showing an example of the groove pattern used in this embodiment, and FIGS. 7(A), 7(B), 7(C), 7(D) and 7(E) are time charts of tone generation showing an example of how an original arpeggio pattern will be modified by means of a grooving function in the embodiment. In this example groove pattern, the "quantization value" is a "quarter note", and those "user-set groove function values" as a "quantization strength" value, a "groove timing" value, a "groove gate time" value and a "groove velocity" value (although not shown in the data chart) are all determined to be "0.5".

Figures 7A, 7B, 7C, 7D, 7E:
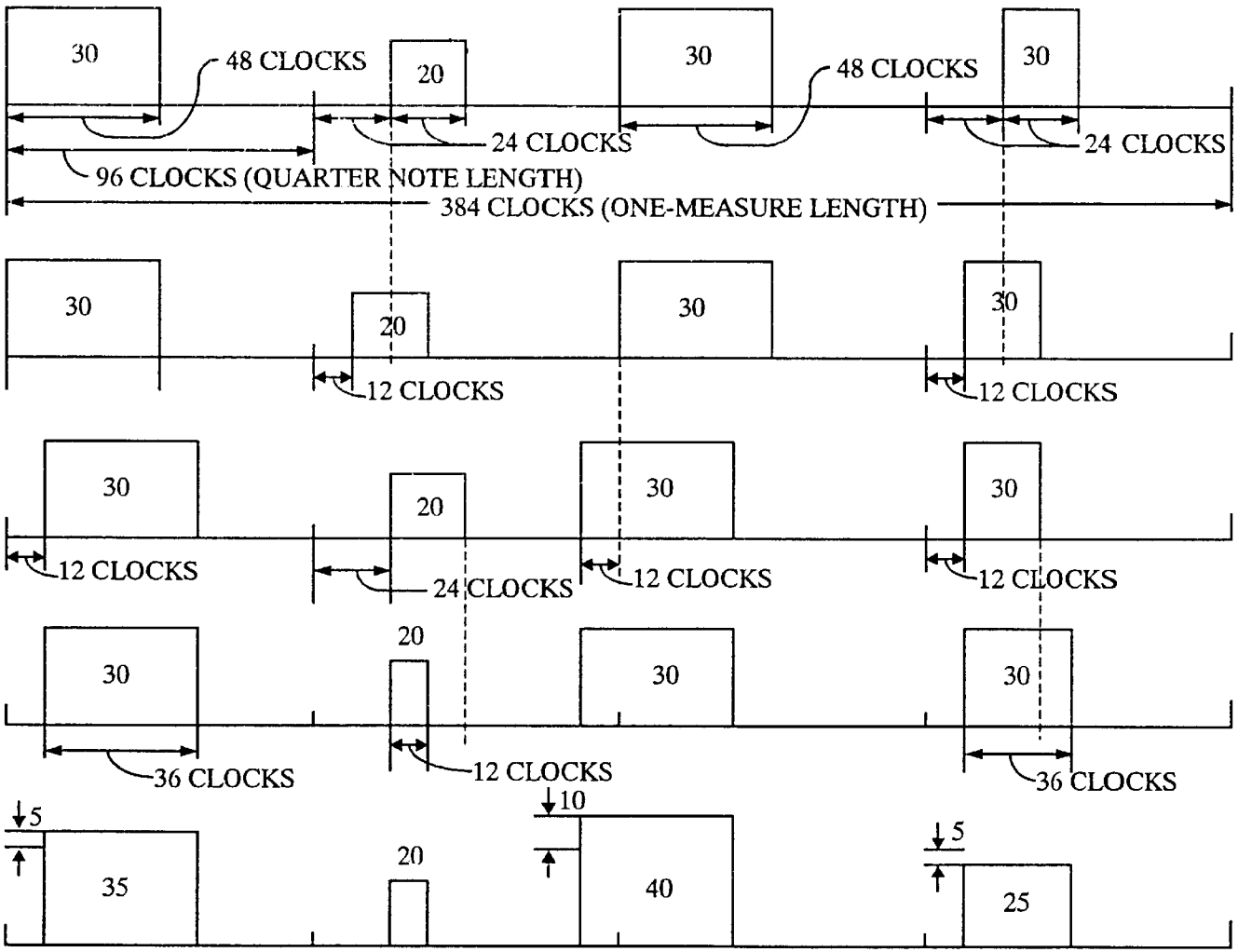
FIGS. 7(A), 7(B), 7(C), 7(D) and 7(E) are time charts of tone generation showing an example of how an original arpeggio pattern will be modified by means of a grooving function in the embodiment.

In the time charts of FIGS. 7(A), 7(B), 7(C), 7(D) and 7(E) illustrating an example of bow an original arpeggio pattern will be modified by means of a grooving function in the embodiment, the abscissa is the time axis (in clock time) and the ordinate is the tone volume axis (in velocity value). The whole abscissa span covers one measure length of 384 clocks. Each of the rectangular blocks above the horizontal axis indicates each of the note generations in which the width represents the note duration in terms of clock time and the height represents the tone volume in terms of velocity value. The time chart of FIG. 7(A) represents the original stored arpeggio pattern. The note to be generated at the first (i.e. #1) grid has a timing value of "0" (at the very head of the measure), a gate time value of "48", and a velocity value of "30". The note at the second grid has a timing value of "24" indicating the delay of tone generation by 24 clocks from the normal second beat timing, a gate time value of "24" indicating the duration of tone generation for 24 clocks, and a velocity value of "20" indicating the intensity of tone generation in the amount of 20. The note at the third grid has a timing value of "0" indicating no delay of tone generation from the normal third beat timing, a gate time value of "48", and a velocity value of "30". The note at the fourth grid has a timing value of "24" indicating 24-clock delay of tone generation from the normal fourth beat timing, a gate time value of "24", and a velocity value of "30".

First the effect of quantization strength is explained with reference to FIG. 7(B) in comparison with FIG. 7(A). The quantization strength, in this instance "0.5", influences the originally deviated amount of each note generation timing by the factor of "0.5" (i.e. every deviated amount is multiplied by 0.5 to make a new amount of deviation). As the note generation timing of the first and third grid in the arpeggio pattern is at the exact beat timing without deviation, the deviation value is "0" and hence the new amount is also "0". There will be no change in position of these two note generation timing. But as the note generation timing of the third and the fourth grid in the arpeggio pattern is at a later timing with a delay of 24 clocks from the exact beat timing, the deviation value is "24" and hence the new amount of delay is "12" (i.e. 0.5 times 24). Thus, both of the notes will be generated at a 12-clock delayed timing from the respective exact beat timings as shown in FIG. 7(B).

Based on thus quantized arpeggio pattern of FIG. 7(B), the timing, the gate time and the velocity of note generation will be modified in accordance with the groove pattern of FIG. 6 and the above explained user-set groove function values. It should be understood here that the quantization strength of "0.5" halves every value of the clock shifts and the velocity offsets in the FIG. 6 chart, and halves every difference of the gate time rate from 1.0 in the FIG. 6 chart (i.e. 0.5 becomes 0.75, 0 becomes 0.5, 1.0 stays 1.0, and 2.0 becomes 1.5). FIG. 7(C) illustrates a resultant arpeggio pattern with modification by the clock shifts (of the above described quantized amount) in the groove pattern from the arpeggio pattern obtained at FIG. 7(B). FIG. 7(D) illustrates a resultant arpeggio pattern with modification by the gate time rate (of the above described quantized amount) in the groove pattern from the arpeggio pattern obtained at FIG. 7(C). FIG. 7(E) illustrates a resultant arpeggio pattern with modification by the velocity offset (of the above described quantized amount) in the groove pattern from the arpeggio pattern obtained at FIG. 7(D).

The mathematical relations in the above modification processing will be expressed by the following formula with respect to the timing (t), the gate time (g) and the velocity (v). It is assumed that the user-set groove function values (i.e. groove timing, groove gate time and groove velocity) are common to all the grids.

$$tN=tO+(CS\times GvT)$$

$$gN=gO\times\{1+(GTR-1)\times GvGT\}$$

$$vN=vO+(VOF\times GvV)$$

wherein, tN is a new timing, tO is an old timing, CS is a clock shift, GvT is a groove timing, gN is a new gate time, gO is an old gate time, GTR is a gate time rate, GvGT is a groove gate time, vN is a new velocity, vO is an old velocity, VOF is a velocity offset, and GvV is a groove velocity.

Figure 4:
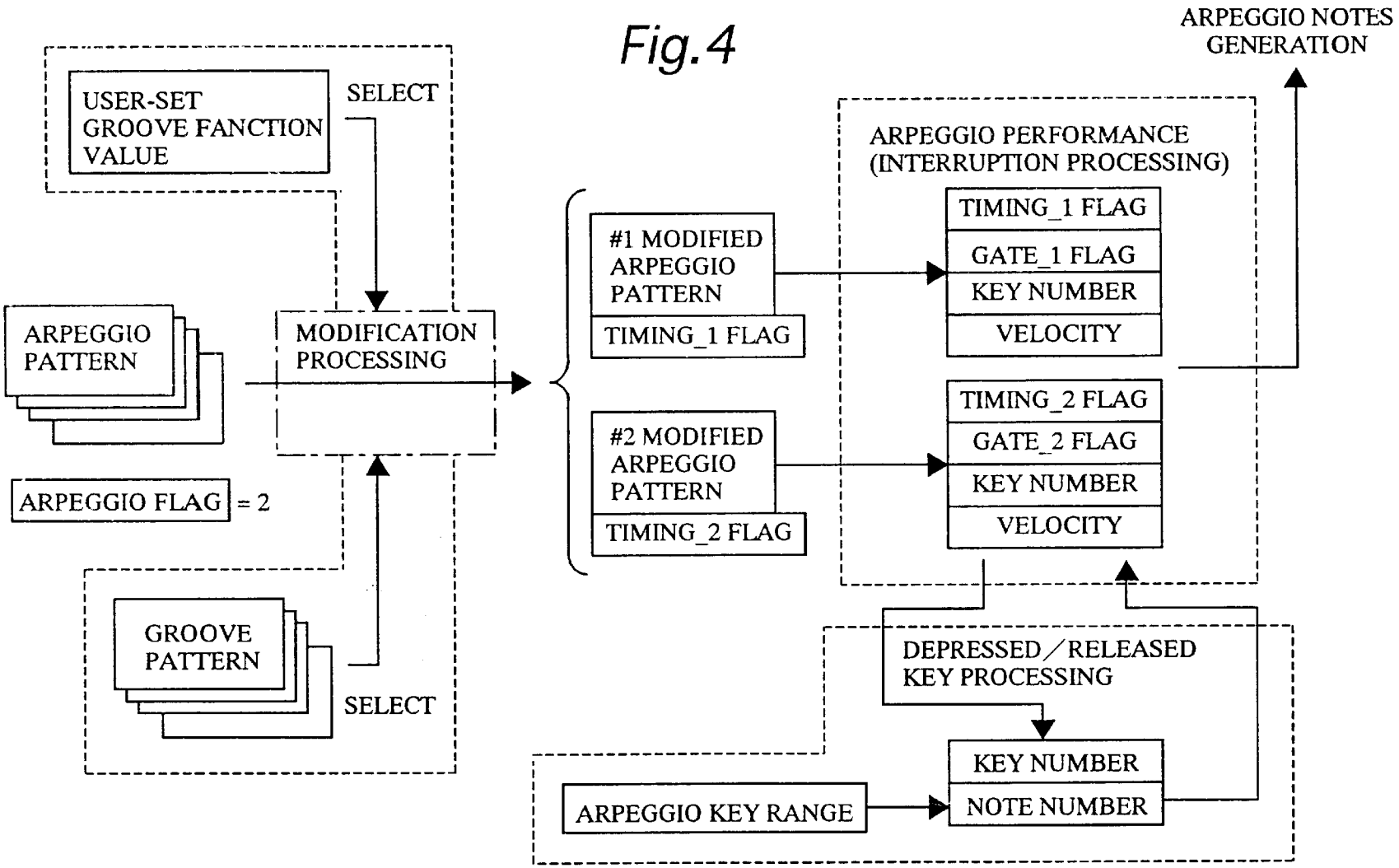
FIG. 4 illustrates an outline of the conceptual construction and function of the main portion of the embodiment.
Figure 5:
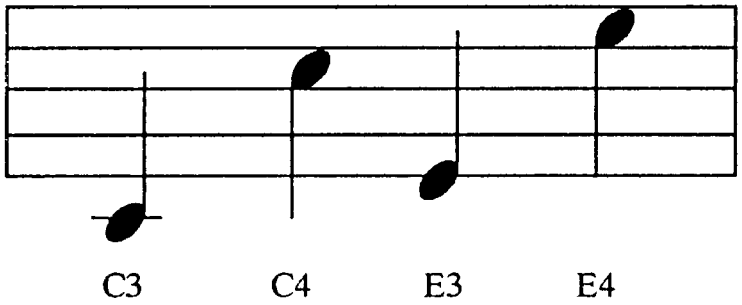
FIG. 5 is a musical notation of an actual example of arpeggio performance realized in the embodiment.

FIG. 4 illustrates an outline of the conceptual structure and function of the main portion of the embodiment. A plurality of arpeggio patterns and a plurality of groove patterns are stored in the ROM 2 or RAM 3. When the user sets the apparatus in the arpeggio mode, a plurality of arpeggio patterns and a plurality of groove patterns will become selectable. Each of the arpeggio patterns and the groove patterns is identified from another by an identifier number or the like, which number is to be selected and stored in the RAM 3 for selecting out the intended arpeggio pattern and groove pattern. The RAM 3 is provided with a storage area for an arpeggio flag to indicate the state of selection of the arpeggio patterns. In this arpeggio flag is set a value "0" when no arpeggio pattern is selected, a value "1" when one arpeggio pattern is selected, and a value "2" when two arpeggio patterns are selected.

This embodiment is constructed such that two arpeggio patterns are selectable at a time from among the stored patterns and further that a desired groove pattern can be selected for each selected arpeggio pattern. And each selected arpeggio pattern will be modified in accordance with the inputted user-set groove function values and the selected groove pattern as specifically exemplified above. The two modified arpeggio patterns are stored in the RAM 3 respectively as a #1 modified arpeggio pattern and a #2 modified arpeggio pattern. The groove patterns may not necessarily be selected it case the groove friction is not required. In storing the #1 and #2 arpeggio patterns, the timing values in the respective data set for the first note (in FIG. 2) in the respective modified arpeggio patterns are respectively set into the timing_1 flag and the timing_2 flag which are work areas for storing the timing data for die modified arpeggio patterns. When the data are not modified by the groove function, the timing data values of the first note data set existing in the selected arpeggio pattern are respectively set in those flag areas.

Under the arpeggio mode, when the depressed/released key processing detects key depressions in the arpeggio key range in the keyboard 4, the note numbers of the depressed keys are assigned to the key numbers as described before, the interruption processing for arpeggio performance controls the timing_1 flag, the gate_1 flag, the timing_2 flag and the gate_2 flag, and arpeggio notes are generated based on the key numbers and velocity values included in the #1 and #2 modified arpeggio patterns or, in case of no modification by groove patterns, in the #1 and #2 selected arpeggio patterns. Thus, the arpeggio performances in two kinds of arpeggio patterns are available.

Figure 8:
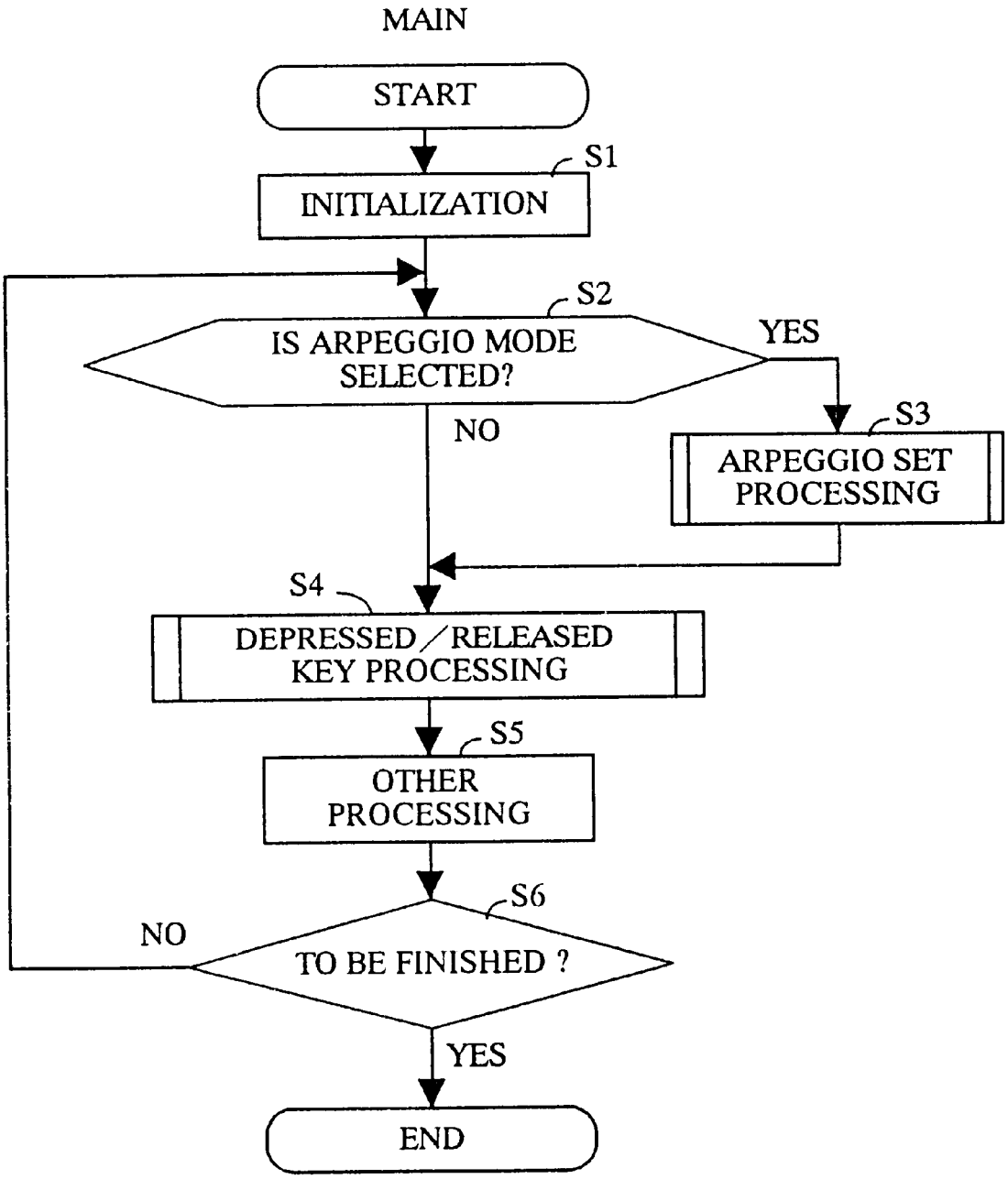
FIGS. 8 is a flowchart showing the main routine flow of a control program in the embodiment.

FIG. 8 is a flowchart showing the main loop of the control program in this embodiment, and FIGS. 9(A) through 11(B) are flow charts showing subroutines and interruption processing in this embodiment. Referring these figures, the operation of the embodiment will be described hereinbelow. In the description below and in the flowcharts, the respective flags used in the control are express as below, in which the same notation means both the flag name and the data content according to the context for the sake of simplicity, unless otherwise intended specifically.

arpeggio: a flag indicating the state of selection of arpeggio patterns;

timing_1: a flag for storing the "timing" value in the #1 selected arpeggio pattern or the #1 modified arpeggio pattern;

timing_2: a flag for storing the "timing" value in the #2 selected arpeggio pattern or the #2 modified arpeggio pattern;

gate_1: a flag for storing the "gate time" value in the #1 selected arpeggio pattern or the #1 modified arpeggio pattern;

gate_2: a flag for storing the "gate time" value in the #2 selected arpeggio pattern or the #2 modified arpeggio pattern;

time: a flag representing the clock count from the start of arpeggio note generation up to the current time point; and run: a flag representing whether an instruction to start arpeggio note generation has been issued or not.

As the power switch is turned on, the CPU 1 starts the processing of the main routine of FIG. 8. Step S1 is to initialize the system including setting "0" value in the flags arpeggio, timing_1, timing_2, gate_1, gate_2, time and run. Step S2 judges whether the arpeggio mode is being selected. If the arpeggio mode is selected, the process moves forward to step S3 to conduct the arpeggio set processing of FIG. 9 before going to step S4, and if the arpeggio mode is not selected, the process moves directly to step S4 for the depressed/released key processing of FIG. 10. After the processing of step S4, other processing including detection of actuation status of the panel switches 8 and the associated processing in response to the switch actuations at step S5. Step S6 is to judge whether an instruction as to finish the operation has been made, for example, by turning of the power switch. If the system is to be finished, the processing will go to an end, and if not, the processing goes back to step S2. When the arpeggio setting switch in the panel is actuated, step S5 detects such actuation and conducts associated processing, and thereafter step S2 judges the selection of the arpeggio mode.

Figure 9A:
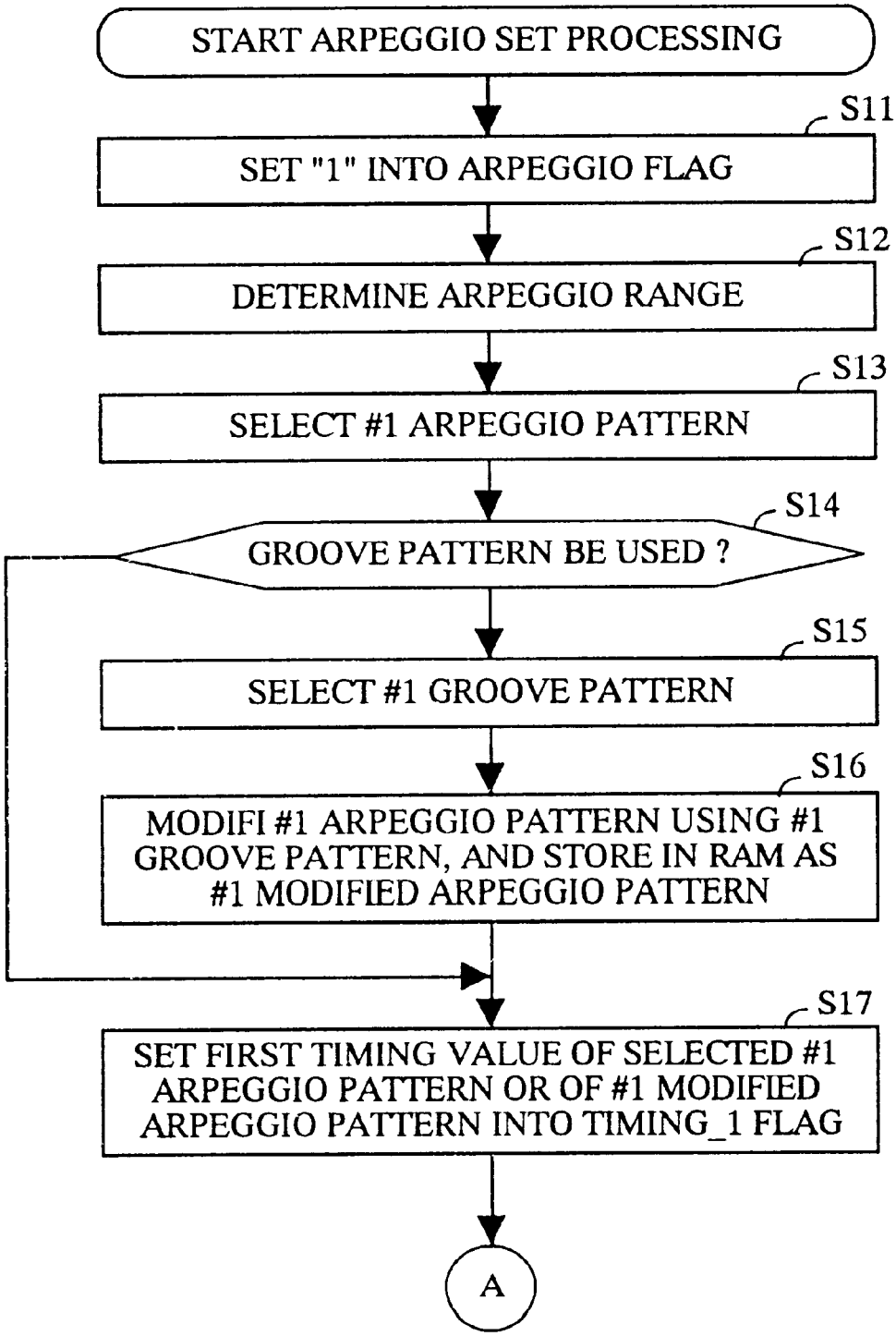
FIGS. 9(A) and 9(B) in combination is a flowchart showing the arpeggio set processing in the embodiment.
Figure 9B:
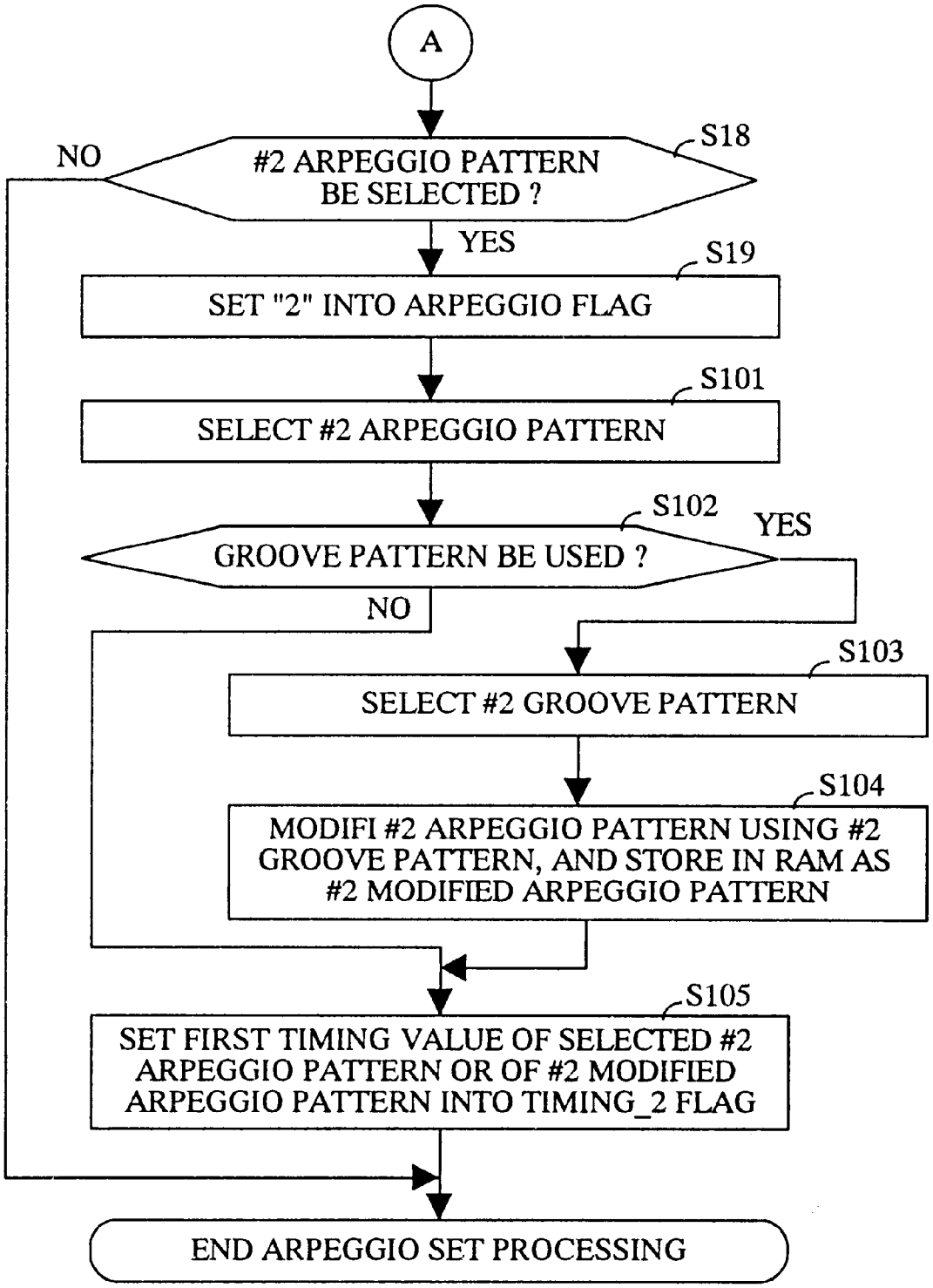

FIGS. 9(A) and 9(B) in combination is a flowchart showing the arpeggio set processing in the embodiment, in which the two figures are connected at the same encircled letter A points with each other. As the arpeggio set processing starts, step S11 sets "1" into the arpeggio flag, and step S12 determines the arpeggio key range by conducting processing responsive to the user's input manipulation. Step S13 conducts processing for selecting a first arpeggio pattern in response to the user's input manipulation. Step S14 judges whether the user's input instruction requests to use the groove pattern, and in case of "NO", the process goes directly to step S17, while in case of "YES", the process moves forward to step S15 to conduct processing of selecting a first groove pattern. Step 816 then modifies the #1 arpeggio pattern using the #1 groove pattern and stores the modified arpeggio pattern into the predetermined area in the RAM 3 as a first modified arpeggio pattern before moving to step S17. Step S17 sets the first timing value of the selected #1 arpeggio pattern (in case the groove pattern is not used) or of the #1 modified arpeggio pattern (in case the groove pattern is used) into timing_1 flag before moving to step S18.

Step S18, processing for the user's input manipulation, judges whether the user has selected to use #2 arpeggio pattern, and if the answer is "NO", the processing goes to its end. If the #2 arpeggio pattern is to be selected, step S19 sets "2" into the arpeggio flag, and step S101 processes for the user's input manipulation and conducts processing of selecting #2 arpeggio pattern. Next, step S102, as in the above step S14, judges whether the user's input instruction requests to use the groove pattern, and in case of "NO", the process goes directly to step S105, while in case of "YES", the process moves forward to step S103 to conduct processing of selecting a second groove pattern. Step S104 then modifies the #2 arpeggio pattern using the #2 groove pattern and stores the modified arpeggio pattern into the predetermined area in the RAM 3 as a second modified arpeggio pattern before moving to step S105. Step S105 sets the first timing value of the selected #2 arpeggio pattern (in case the groove pattern is not used) or of the #2 modified arpeggio pattern (in case the groove pattern is used) into timing_2 flag before ending the arpeggio set processing.

In the selected arpeggio pattern or in the modified arpeggio pattern, the respective data pieces such as the timing data, the gate time data, key number data, the octave data and the velocity data are read out in sequence using the predetermined data reading pointer which is renewed sequentially. Similar to the above-mentioned setting of the first timing value into the timing_1 or timing_2 flag, after reading out the data (in such a case, timing value) the pointer is set to the next data (in such a case, gate time).

Through the above-mentioned processing, the #1 and #2 arpeggio patterns can be selected, and further these arpeggio patterns can be modified using desired groove patterns to make a wide variety (not limited to those previously stored in data base) of arpeggio patterns. As will be apparent to the reader, the number of arpeggio patterns and the use of groove patterns are arbitrary according to the desire of the user.

In the succeeding processings, as described in the following, the arpeggio pattern to be processed may be the arpeggio pattern selected from among the previously prepared (stored) data base or may be the modified arpeggio pattern using the groove pattern according to the situation. Therefore in the following description, both of them will be simply referred to as an "arpeggio pattern".

Figure 10A:
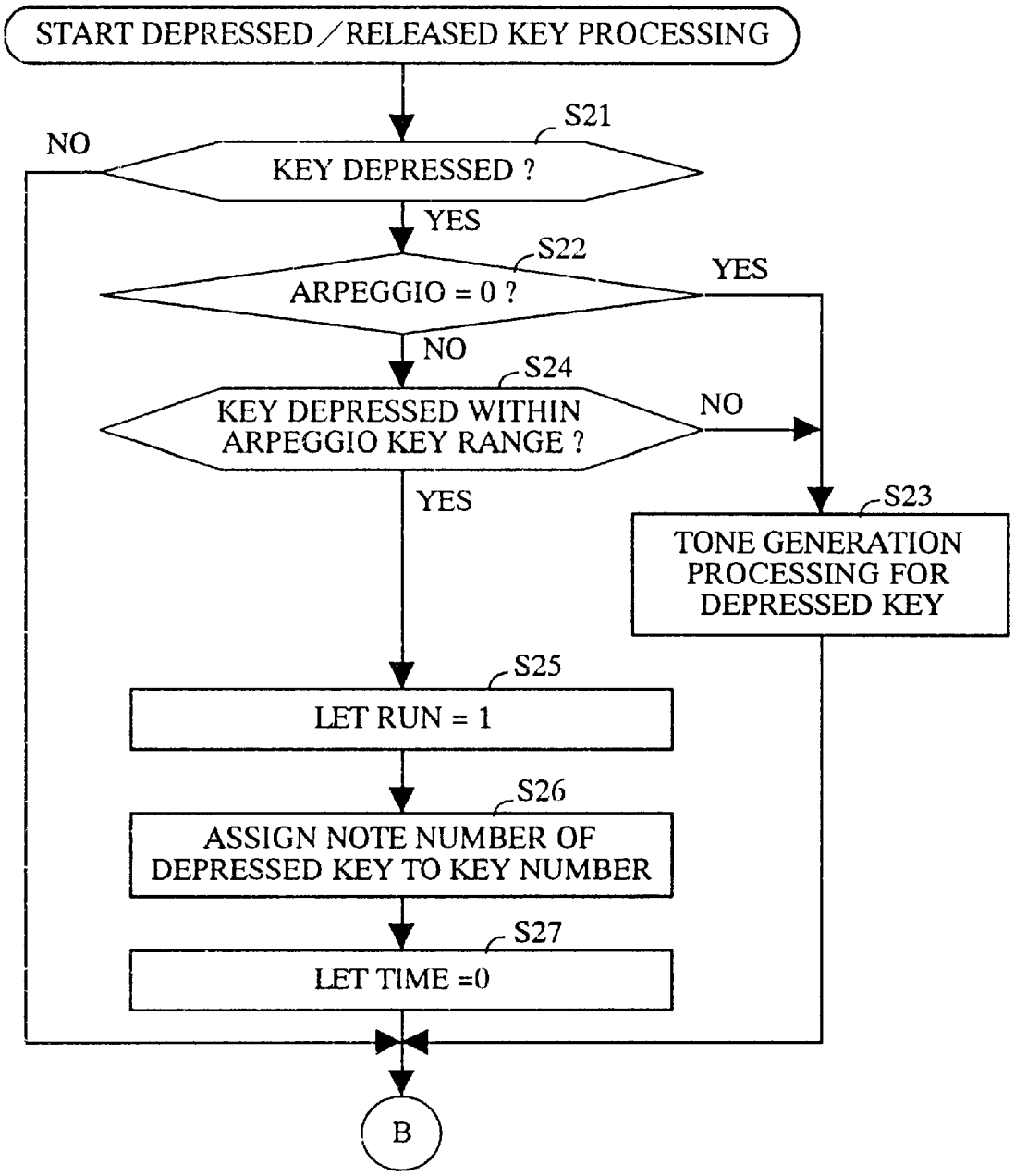
FIGS. 10(A) and 10(B) in combination is a flowchart showing the depressed/released key processing in the embodiment, FIGS. 11(A) and 11(B) in combination is a flowchart showing the interruption processing in the embodiment.
Figure 10B:
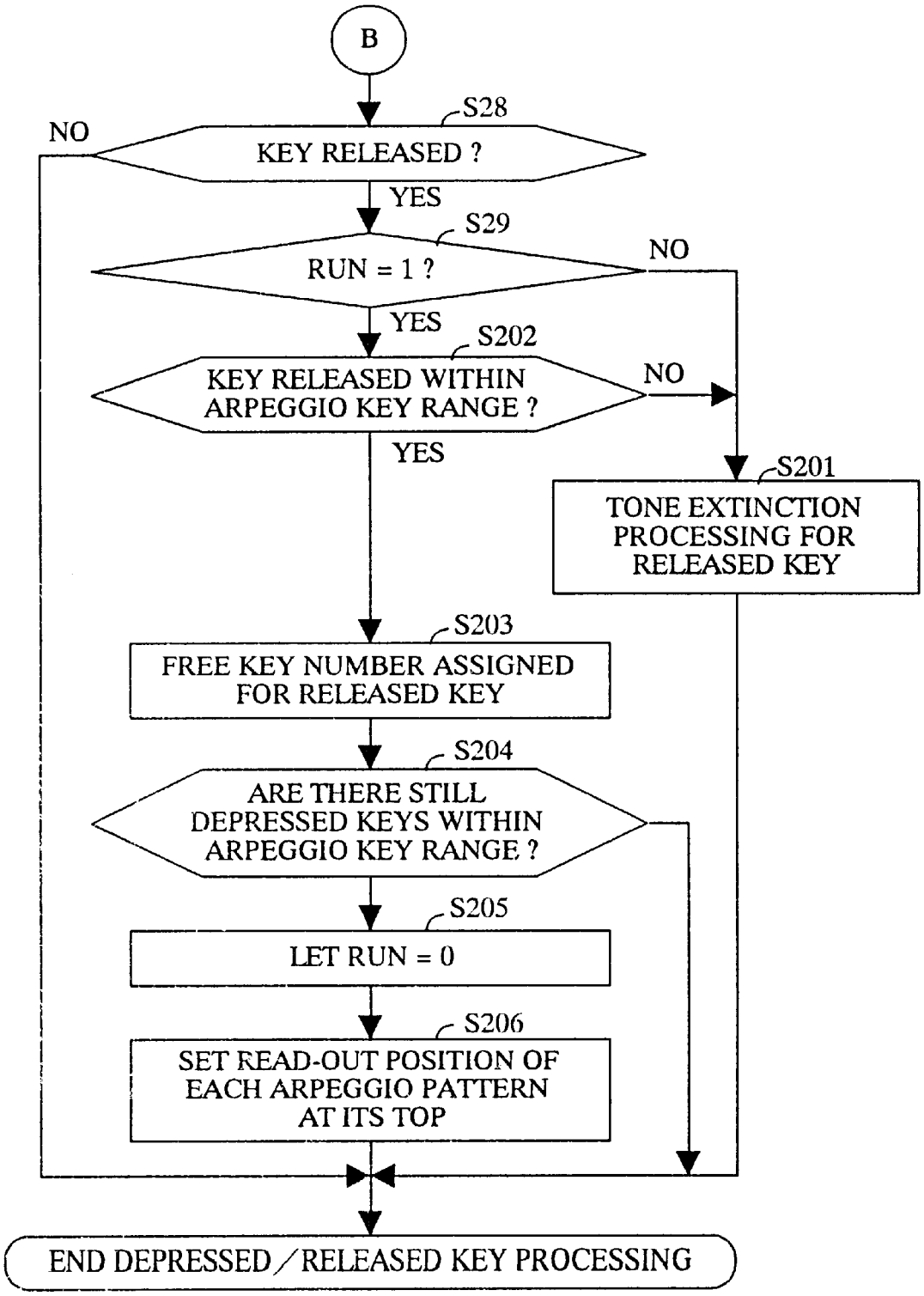

FIGS. 10(A) and 10(B) in combination is a flowchart showing the depressed/released key processing in the embodiment, in which the two figures are connected at the same encircled letter B points with each other. This flowchart constitutes a subroutine chart for the step S4 in the main routine of FIG. 8. As the depressed/released key processing starts, step S21 judges whether there are any key depressed, and if there is no key depressed, the process skips to step S28, while if there are any key depressed, then step S22 judges whether arpeggio=0. The flag arpeggio=0 means that the arpeggio performance is not selected by the user, and thus the process moves to step S23 for the ordinary performance processing, i.e. the processing for generating tones according to the designation by the respective depressed keys on the keyboard musical instrument and skips to step S28. If arpeggio=0 is not true, step S24 judges whether the depressed key is within the arpeggio key range or not. If "NO", the process moves to step S23 to conduct the same process as mentioned above, if "YES", the process moves to step S25 to let run=1 and goes to step S26. Step S26 assigns the note numbers of the depressed keys in the ascending order (from the lowest depressed key upward) to the not-yet-assigned key numbers in the ascending order (from the lowest empty key number flag upward), and step S27 let time=0 before moving to step S28.

Whether a plurality of keys are depressed substantially simultaneously or successively (one after another) in the arpeggio key range, this depressed/released key processing is repeated for every detection of an individual key, and the key numbers (e.g. from "1" to "4") are individually assigned, in an ascending order from the lowest unoccupied key number, to the note numbers of the depressed keys in the order of ascending notes from the lowest pitch. As long as any keys are depressed in the arpeggio key range, run=1. If all of the depressed keys have been released, the processing from step S28 onward let run=0.

Step S28 judges whether any keys have been released. If there is no key release event, step S28 answers "NO" and the process goes to the end of the depressed/released key processing. If there is a key release event, step S28 answers "YES" and then step S29 judges whether run=1. If the answer is "NO", the released key is not a key which had been being depressed in the arpeggio key range (under the non-arpeggio mode, the entire key range is non-arpeggio key range), therefore step S201 simply extinguishes the generation of the tone of the released key to end the depressed/released key processing. If run=1, step S202 judges whether the released key is a key within the arpeggio key range, and if not, the same process by step S201 takes place as described just above. If the released key belongs in the arpeggio key range, step S203 frees the key number which has until now been assigned to the note number of the released key, i.e. makes the key number available for future assignment of a new note number before moving forward to step 204. Thus the key number to which the note number of the released key has been allotted loses the corresponding note number, and no tone generation occurs at the generation timing instructed for this key number. This makes a rest in musical notation. Alternatively, step S203 may be so arranged that the rest of the keys, if any, in the arpeggio key range (i.e. the keys still being depressed in the arpeggio key range) shall be re-allotted to the key numbers in the correspondingly ascending order one to one from the lowest note anew.

Step S204 judges whether there are still any keys depressed in the arpeggio key range. If there are any keys being depressed in the arpeggio key range, the depressed/released key processing of this time (loop) will end without further steps, but if there is no key being depressed in the arpeggio key range, step S205 sets the run flag at "0" (i.e. run=0) and step S206 sets the read-out position of each arpeggio pattern at its top (places the pointer at the data top) before ending this depressed/released key depression. In other words, at the timing of clearing all depressed keys in the arpeggio key range, the data read-out position of the arpeggio pattern is set to the top and that timing is set into timing_1 or timing_2 flag to prepare for the next arpeggio start.

Figure 11A:
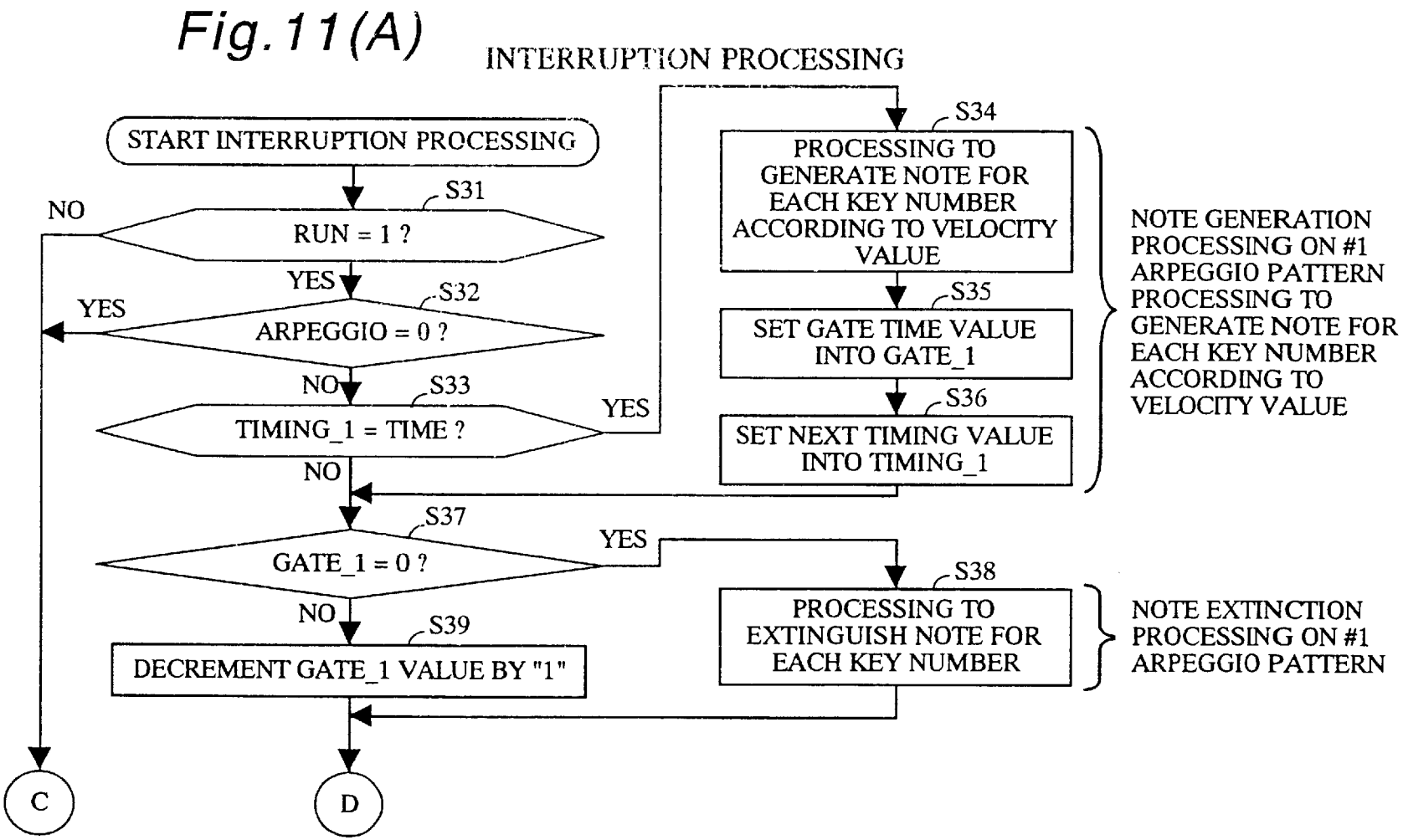

FIGS. 11(A) and 11(B) in combination is a flowchart showing the interruption processing in the embodiment, in which the two figures are connected at the same encircled letter C points with each other and at D points with each other. The interruption processing is periodically initiated by the clock signal from the timer 10. First, step S31 judges whether run=1, and if "NO", it means that no key is being depressed in the arpeggio key range and the process skips to step S309 for automatic performance processing, and if "YES", it means that some keys are being depressed in the arpeggio key range and the process advances to step S32 to judge whether arpeggio=0. If arpeggio=0, it means that no arpeggio pattern is selected, and therefore the process skips to step S309. If not arpeggio=0, it means that some arpeggio patterns are selected, and therefore the process moves forward to step S33 to judge whether timing_1=time.

If not timing_1=time, the current timing ("time") is not the note generation timing in the #1 arpeggio pattern, the process skips to step S37, while if timing_1=time, the current timing has reached the note generation timing in the #1 arpeggio pattern, the process advances to step S34 to successively read out the data following the timing data (as shown in FIG. 2) in the #1 arpeggio pattern one after another and output the note numbers (if there is octave shift data, the note number of the octave-shifted note, the same being applied hereinbelow ) of the note pitches corresponding to the key numbers, the velocity values and the note-on flags to the tone generator circuit 5 for the note generation processing. Step S35 then sets the read-out gate time value into the gate_1 flag, step S36 then sets the next timing value into the timing_1 flag before moving to step S37.

Step S37 judges whether gate_1=0, and if gate_1=0, it means that the current timing is the time to extinguish the note which has been being generated in the #1 arpeggio pattern, and accordingly step S38 outputs the note number of the note pitch and the key-off instruction corresponding to the key number to the tone generator circuit 5 for the note extinction processing before moving to step S301. If not gate_1=0, step S39 decrements the gate_1value by "1" before moving to step S301.

Step S301 judges whether arpeggio=2 or not, and if "NO", it means that only #1 arpeggio pattern is selected, and the process skips to step S309 without processing for #2 arpeggio pattern performance. If arpeggio=2, it means that #2 arpeggio pattern is selected, and therefore the process advances to step S302 to judge whether timing #2=time. The processing through steps S302 to S308 is the processing similar to the processing through steps S33 to S39 for the #1 arpeggio pattern except that the processing through steps S302 to S308 is for the #2 arpeggio pattern.

If not timing_2=time, the process skips to step S306, whereas if timing_2=time, the process advances to step S303 to generate the note for the key number of the data set for each arpeggio note including the timing data under process now in the #2 arpeggio pattern based on the velocity value included in the same data set. Next at step S304, the read-out gate time value into gate_2 flag, and then the next timing value is set into timing_2 at step S305. Step S306 judges whether gate_2=0, and when "YES", step S307 conducts processing to extinguish the note corresponding to the key number under process before moving forward to step S309, and when "NO", step S308 decrements the gate_2 value by an amount of "1" to go to step S309.

Step S309 is the processing for automatic musical performance. The automatic performance processing realizes an automatic musical accompaniment, which is conducted by generating notes according to the sequentially read-out musical performance data aligned timewise in succession based on the clock signal just as the automatic arpeggio performance. Consequently, the automatic performance processing is included in this interruption processing. The automatic performance processing at step S309 typically plays a substantial role when the apparatus is set at the "automatic accompaniment mode", and when both the arpeggio mode and the automatic accompaniment mode are set, the data tracks of the bass and the rhythm for the manual performance data may be read out to generate the tones for the bass and the rhythm together with the tones of the arpeggio performance.

When the above automatic performance processing is over, step S310 judges whether time<384, and if "YES", the process is still On the way of a measure, and hence step S311 increments the time value by "1" before ending the interruption processing. If not time<384, the time for one measure has already passed, then step S312 sets the time flag at "0" (time=0) before ending the interruption processing.

Through the above described processing, the apparatus of the present invention provides two kinds of arpeggio note generation based on #1 and #2 arpeggio patterns and on the note numbers corresponding to the keys depressed in the arpeggio key range, which enhances arpeggio performance and provides arpeggio note generation with rich expressivity.

Figure 12:
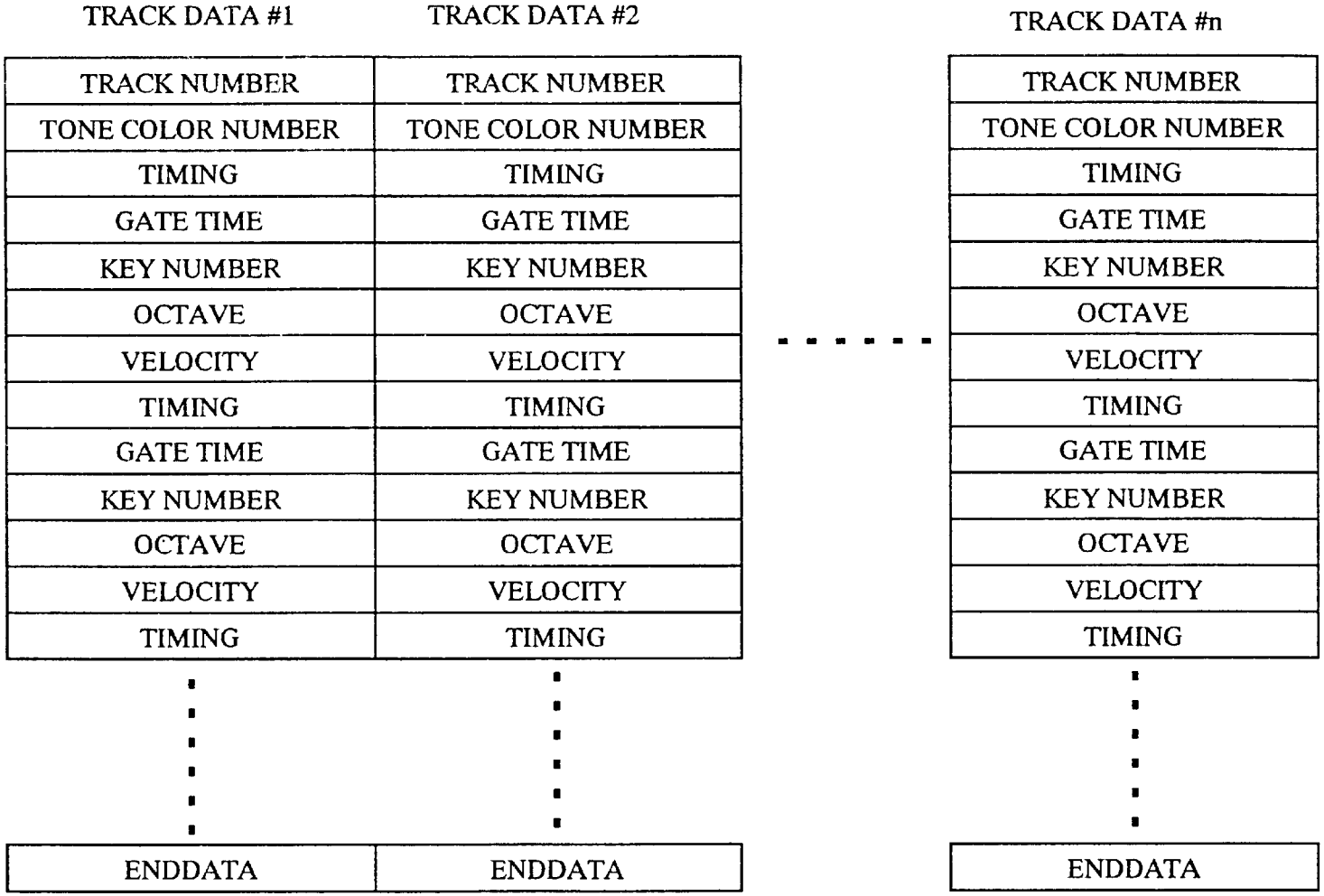
FIG. 12 is a data format illustrating multi-track arpeggio patterns provided in another embodiment of the present invention.

In the above embodiment, there are provided a plurality of arpeggio patterns and two are selected independently from among them, but arpeggio patterns may be provided in the form of multi-track data as shown in FIG. 12. In FIG. 12, there are a plurality of track data from track #1 to #n in a laterally engaged set in which each track data constitutes an individual arpeggio pattern (herein referred to as "track arpeggio pattern"). Each track data of the track arpeggio patterns includes "track number" data representing the number of the track and "tone color number" data representing the identifying number to designate the tone color for the note data of each track in addition to the "timing" data, "gate time" data, "key number" data, "octave" data and "velocity" data as each data set for one note designation as was the case in FIG. 2.

The data processing manner in the case of using the track arpeggio patterns is almost the same as the above-described embodiment, wherein the note generation processing and the note extinction processing on an arpeggio pattern by steps S33 to S39 will be conducted for all track data in parallel per interruption processing. In such a case, each track contains each individual "timing" flag for storing the timing data for each track for the processes corresponding to step S33 to step S36. Similarly, for the processes corresponding to steps S37 to S39, each track contains each individual "gate time" flag for storing the gate time data for each track.

Although the generated tones in the aforementioned embodiment was in a single kind of tone color which was selected for the ordinary keyboard performances, the system utilizing the above-mentioned track arpeggio patterns can realize arpeggio note generation in different tone colors for different tracks.

Further, it would be a hard job for the beginners to select an arpeggio pattern which matches another certain arpeggio pattern from among a plurality of arpeggio patterns when simultaneous note generation are to be conducted using a plurality of arpeggio patterns. But the use of above-mentioned track arpeggio patterns makes it possible to previously prepare a plurality of arpeggio patterns in a set by the multi-track data, so even a beginner can easily enjoy the arpeggio note generation by using a plurality of arpeggio patterns which will match each other in view of the music progression. Thus, more versatile arpeggio note generation will be possible with this invention requiring less manipulation than the conventional apparatus. Alternatively, the apparatus using the above-mentioned track arpeggio patterns may be constructed such that the arpeggio note generation corresponding to any particular desired tracks can be muted according to the user's preference in order to use not all the arpeggio patterns simultaneously.

In the above embodiment, there are provided four key numbers "1" to "4", and the note numbers corresponding to the keys depressed in the arpeggio key range are respectively assigned to those four key numbers so that the arpeggio notes are determined by the note numbers which are quoted by the key numbers included in the arpeggio pattern data. Therefore, in case the number of depressed keys are smaller than the number of key numbers (four in this embodiment), there may be a key number(s) which is (are) not assigned to any note number(s). But the arpeggio patterns always include a key number for each note data set, and therefore a note data set which include a key number not assigned to a note number will be a rest in musical notation. Alternatively, such a blank key number (i.e. a key number not occupied with a note number) may be filled with a note number of such a key as the highest or the lowest key among the depressed keys additionally.

Alternatively further, without using the key number data, and using only the timing data, the gate time data and the velocity data in the arpeggio patterns, the note pitch of each arpeggio note in the arpeggio pattern may be determined by sequentially allotting the note numbers of the depressed keys to the note generation timings according to some predetermined rule using the order of key depressions and the order of note generations. In such a case, there may be provided plural kinds of rules and the rules may be subject to user's selection.

Further in the embodiment, the arpeggio patterns and the groove patterns are data sets having a length of one musical measure, but the data length may not be limited to one measure but may be of plural measures.

Further in the embodiment, the arpeggio key range is to be set by the user, but it may be predetermined in the apparatus.

In the embodiment, at the time the groove pattern is selected, the arpeggio pattern selected for use is modified to prepare beforehand the modified arpeggio pattern and the arpeggio note generation will be realized based on the modified arpeggio pattern. But the grooving process may be introduced amid the execution of the arpeggio note generation by modifying the data set for each note in the arpeggio pattern with reference to the data set at each grid in the groove pattern on the way of arpeggio performance.

In the embodiment described above, two groove patterns are selected to be used for modifying two arpeggio patterns, respectively. But the invention should not be construed to be limited to such a construction, as two arpeggio patterns may be modified using a single groove pattern. Or alternatively, a single arpeggio pattern may be modified using more than one groove pattern to provide more than one modified arpeggio pattern. More than one arpeggio pattern may drive simultaneous arpeggio note generation in a plurality of modified arpeggio patterns.

Further, the apparatus may include a device for displaying recommended groove pattern candidates which will fit each selected arpeggio pattern so that a beginner can easily practice arpeggio pattern modification.

In the embodiment described above, the same note pitch information of the keys depressed in the arpeggio key range designates the arpeggio notes to be generated simultaneously according to the two arpeggio patterns selected by the user, but the apparatus may alternatively constructed such that different note pitch information may be used for the two arpeggio patterns separately so that two different arpeggio performances in separate arpeggio patterns are played with different notes. For example, among the note pitch information on the keys depressed in the arpeggio key range, the information on the even-numbered keys from the lowest key upward is to be used for arpeggio note generation in the #1 arpeggio pattern, while the odd-numbered keys from the lowest is to be used for arpeggio note generation in the #2 arpeggio pattern. Further for example, two arpeggio key ranges may be set and the note pitch information from the respective key ranges may be used with the #1 and the #2 arpeggio pattern, respectively. Or further, the note pitch information of a plurality of keys depressed in the arpeggio key range may be used with the #1 arpeggio pattern, while another pitch information obtained by shifting the note pitch information up or down by one octave may be used with the #2 arpeggio pattern to play arpeggio performances.

In the above described embodiment, the key numbers are assigned from the lowest number upward to the depressed keys in the arpeggio key range from the lowest depressed key upward, but the key numbers may be assigned from the lowest number upward to the depressed keys in the order of key depressions (i.e. from the earliest key onward).

In the above described embodiment, two kinds of arpeggio patterns and two kinds of groove patterns are employed, but more than two arpeggio patterns or groove patterns may be employed to conduct more than two kinds of arpeggio performances.

In the above embodiment, the data format of the arpeggio pattern is in the form of "event+absolute time" representing the timings for arpeggio note generation in terms of absolute time from the beginning of a musical piece or of each measure, but the format may be of "event+relative time" representing the timings in terms of time interval (duration in clock counts) from the preceding event to each event. Further, an arpeggio pattern itself may be in the form of "note pitch (or rest)+duration" representing the arpeggio pattern using the pitch and the duration of each note or the duration of each rest. Alternatively, the arpeggio pattern may be stored in the memory according to address-dependent direct data mapping (beta-gaki mapping) in which a memory area is secured to cover the sufficient number of addresses for the resolution of events (i.e. one clock count in the embodiment) with each address allotted for each timing, and then the key number data, velocity data, etc. of each event are stored at the addresses corresponding to the event time. Any other form of data storage may be available for those skilled in the art.

The tempo for arpeggio note generation can be varied in various manners. The period of tempo clock (i.e. of interruption signal) may be varied, the values of timing data may be converted according to the intended tempo with the clock itself being kept at the same period, or a unit count value (e.g. a decremental value) for counting the timing data at each processing may be changed, or any other known manners may be employed.

In the above-mentioned embodiment, the arpeggio patterns, the groove patterns, and the control programs are stored in the ROM 2 beforehand. Alternatively, the arpeggio patterns, the groove patterns, and the control programs may be stored in a CD-ROM, so that the programs and data are read out from the CD-ROM and loaded in the hard disk (equipped according to necessity). Then the CPU 1 develops (spreads) the control program from the hard disk onto the RAM 3, and controls the operation of arpeggio note generation based on the program on the RAM 3 as in the embodiment explained above. This means that the CPU 1 conducts the similar operation in the system as in the case the control program is stored in the ROM 2. This way is advantageous in that installation of a new control program, or addition or up-grading of the control program can be easily. Alternatively, the control program, etc. may be stored in floppy disks, a magneto-optical disk, etc. and may be supplied to the RAM 3 or the hard disk.

Further, the arpeggio patterns, the groove patterns and the control program may be down-loaded from an external source using the interface 12. In this case, for example, the interface 12 is connected to a server computer via a LAN (local area network) or any communication network such as the Internet and a public telephone line, and receives the delivery of such arpeggio pattern data, groove pattern data and control program data from the server computer to down-load the same onto the hard disk.

The present invention can be applicable not only to an integrated keyboard type electronic musical instrument, but also to a string type instrument, a wind type instrument, or else. The tone generator circuit and the automatic performance system may not be included in an electronic musical instrument, but the tone generator, a sequencer, an effector and so forth may be separate devices being connected by MIDI) cables and other communication lines including various networks.

While the heretofore described explanations relate to examples of electronic musical instruments to which the present invention is applied or applicable, the arpeggio note generating apparatus of the present invention can be configured with a general purpose personal computer and an application software. In such a configuration, the CPU in a personal computer performs various controls using working areas in the RAM with the aid of an OS installed, for example, in the hard disk. The arpeggio patterns, the groove patterns and the control program may be supplied in the form of a recorded medium so that such softwares may be transferred to the hard disk or the like for the CPU to operate similarly as mentioned above. With such a computer, the selection of the arpeggio patterns and the groove patterns may be easily conducted by inputting necessary data using a keyboard or a mouse. A sound board, if any, installed in the personal computer can serve as the tone generator circuit. The personal computer may, off course, be connected to external communication network for any necessary data acquisition.

As will be apparent from the above description, a computer readable medium on which is stored a computer program for generating arpeggio notes according to the manner described belongs to the scope of the present invention. Such a medium may be a ROM, a RAM, a hard disk, a CD-ROM, a magneto-optical disk, and any storage device in an externally locating server computer connected via a communication network. Various manners or technology prevailing in the computer field may also be available in the present invention.

While several forms of the invention have been shown and described, other forms will be apparent to those skilled in the art without departing from the spirit of the invention. Therefore, it will be understood that the embodiments shown in the drawings and described above are merely for illustrative purposes, and are not intended to limit the scope of the invention, which is defined by the appended claims.

What is claimed is:

1. An apparatus for generating arpeggio notes comprising:

a note pitch input device inputting note pitch information which designates pitches of arpeggio constituent notes;

an arpeggio pattern storage device storing a plurality of arpeggio patterns each of which defines at least generation timings of said arpeggio constituent notes;

an arpeggio pattern selection device for selecting at least two arpeggio patterns from said arpeggio pattern storage device; and a tone generator device for generating a plurality of notes for a given arpeggio performance based on said inputted note pitch information and said selected at least two arpeggio patterns.

2. An apparatus for generating arpeggio notes comprising:

a note pitch input device inputting note pitch information which designates pitches of arpeggio constituent notes;

an arpeggio pattern storage device storing at least one arpeggio pattern each of which defines at least generation timings of said arpeggio constituent notes;

a groove pattern storage device storing a plurality of groove patterns each of which includes modification data defining at least one modification amount by which at least the timing of note generation is to be modified;

a groove pattern selection device for selecting at least one groove pattern from said groove pattern storage device;

an arpeggio pattern modification device for modifying at least the timing of note generation of said arpeggio pattern stored in said arpeggio pattern storage device using said modification data in said selected at least one groove pattern; and a tone generator device for generating a plurality of notes for arpeggio performance based on said inputted note pitch information and said modified at least one arpeggio pattern.

3. An apparatus for generating arpeggio notes according to claim 2, wherein said arpeggio pattern storage device stores a plurality of arpeggio patterns;

said apparatus further comprising an arpeggio pattern selection device for selecting a plurality of arpeggio patterns from said arpeggio pattern storage device; and said arpeggio pattern modification device modifies said selected plurality of said arpeggio pattern.

4. An apparatus for generating arpeggio notes comprising:

a note pitch input device inputting note pitch information which designates pitches of arpeggio constituent notes;

an arpeggio pattern storage device storing at least one arpeggio pattern which defines at least generation timings and a tone color of said arpeggio constituent notes;

a modifying device that modifies the arpeggio pattern based on a groove function, and a tone generator device for generating a plurality of notes for arpeggio performance based on said inputted note pitch information and at the timings and in a tone color defined by said modified arpeggio pattern.

5. An apparatus for generating arpeggio notes comprising:

a note pitch input device inputting note pitch information which designates pitches of arpeggio constituent notes;

an arpeggio pattern storage device storing track arpeggio patterns including a plurality of track data sets, each of which defines at least generation timings and a tone color of said arpeggio constituent notes; and a tone generator device for generating a plurality of notes for a given arpeggio performance based on said inputted note pitch information and at the timings and in a tone color defined by at least two of said stored track arpeggio patterns.

6. An apparatus for generating arpeggio notes comprising:

means for inputting note pitch information which designates pitches of arpeggio constituent notes;

means for storing a plurality of arpeggio patterns each of which defines at least generation timings of said arpeggio constituent notes;

means for selecting at least two arpeggio patterns from said arpeggio pattern storing means; and means for generating a plurality of notes for a given arpeggio performance based on said inputted note pitch information and said selected at least two arpeggio patterns.

7. An apparatus for generating arpeggio notes comprising:

means for inputting note pitch information which designates pitches of arpeggio constituent notes;

means for storing at least one arpeggio pattern which defines at least generation timings of said arpeggio constituent notes;

means for storing a plurality of groove patterns each of which includes modification data defining at least one modification amount by which at least the timing of note generation is to be modified;

means for selecting at least one groove pattern from said groove pattern storing means;

means for modifying at least the timing of note generation of said arpeggio pattern stored in said arpeggio pattern storing means using said modification data in said selected at least one groove pattern; and means for generating a plurality of notes for arpeggio performance based on said inputted note pitch information and said modified at least one arpeggio pattern.

8. An apparatus for generating arpeggio notes comprising:

means for inputting note pitch information which designates pitches of arpeggio constituent notes;

means for storing at least one arpeggio pattern which defines at least generation timings and a tone color of said arpeggio constituent notes;

means for modifying said at least one arpeggio pattern based on a groove function; and means for generating a plurality of notes for arpeggio performance based on said inputted note pitch information and at the timings and in a tone color defined by said modified at least one arpeggio pattern.

9. An apparatus for generating arpeggio notes comprising:

means for inputting note pitch information which designates pitches of arpeggio constituent notes;

means for storing track arpeggio patterns including a plurality of track data sets, each of which defines at least generation timings and a tone color of said arpeggio constituent notes; and means for generating a plurality of notes for a given arpeggio performance based on said inputted note pitch information and at the timings and in a tone color defined by at least two of said stored track arpeggio patterns.

10. A method for generating arpeggio notes comprising the steps of:

inputting note pitch information which designates pitches of arpeggio constituent notes;

storing a plurality of arpeggio patterns each of which defines at least generation timings of said arpeggio constituent notes;

selecting at least two arpeggio patterns from among said stored arpeggio patterns; and generating a plurality of notes for a given arpeggio performance based on said inputted note pitch information and said selected at least two arpeggio patterns.

11. A method for generating arpeggio notes comprising the steps of:

inputting note pitch information which designates pitches of arpeggio constituent notes;

storing at least one arpeggio pattern which defines at least generation timings of said arpeggio constituent notes;

storing a plurality of groove patterns each of which includes modification data defining at least one modification amount by which at least the timing of note generation is to be modified;

selecting at least one groove pattern from among said stored groove patterns;

modifying at least the timing of note generation of said arpeggio pattern in said stored arpeggio pattern using said modification data in said selected at least one groove pattern; and generating a plurality of notes for arpeggio performance based on said inputted note pitch information and said modified at least one arpeggio pattern.

12. A method for generating arpeggio notes comprising the steps of:

inputting note pitch information which designates pitches of arpeggio constituent notes;

storing at least one arpeggio pattern which defines at least generation timings and a tone color of said arpeggio constituent notes;

modifying said at least one arpeggio pattern based on a groove function; and generating a plurality of notes for arpeggio performance based on said inputted note pitch information and at the timings and in a tone color defined by said modified at least one arpeggio pattern.

13. A method for generating arpeggio notes comprising the steps of:

inputting note pitch information which designates pitches of arpeggio constituent notes;

storing track arpeggio patterns including a plurality of track data sets, each of hich defines at least generation timings and a tone color of said arpeggio constituent notes; and generating a plurality of notes for a given arpeggio performance based on said inputted note pitch information and at the timings and in a tone color defined by at least two of said stored track arpeggio patterns.

14. A computer readable medium on which is stored a computer program for generating arpeggio notes, said computer program comprising program instructions which, when read and executed by a computer system, configure the computer system to perform the steps of:

inputting note pitch information which designates pitches of arpeggio constituent notes;

storing a plurality of arpeggio patterns each of which defines at least generation timings of said arpeggio constituent notes;

selecting at least two arpeggio patterns from among said stored arpeggio patterns; and generating a plurality of notes for a given arpeggio performance based on said inputted note pitch information and said selected at least two arpeggio patterns.

15. A computer readable medium on which is stored a computer program for generating arpeggio notes, said computer program comprising program instructions which, when read and executed by a computer system, configure the computer system to perform the steps of:

inputting note pitch information which designates pitches of arpeggio constituent notes;

storing at least one arpeggio pattern which defines at least generation timings of said arpeggio constituent notes;

storing a plurality of groove patterns each of which includes modification data defining at least one modification amount by which at least the timing of note generation is to be modified;

selecting at least one groove pattern from among said stored groove patterns;

modifying at least the timing of note generation of said arpeggio pattern in said stored arpeggio pattern using said modification data in said selected at least one groove pattern; and generating a plurality of notes for arpeggio performance based on said inputted note pitch information and said modified at least one arpeggio pattern.

16. A computer readable medium on which is stored a computer program for generating arpeggio notes, said computer program comprising program instructions which, when read and executed by a computer system, configure the computer system to perform the steps of:

inputting note pitch information which designates pitches of arpeggio constituent notes;

storing at least one arpeggio pattern which defines at least generation timings and a tone color of said arpeggio constituent notes;

modifying said at least one arpeggio pattern based on a groove function:

generating a plurality of notes for a given arpeggio performance based on said inputted note pitch information and at the timings and in a tone color defined by said modified at least one arpeggio pattern.

17. A computer readable medium on which is stored a computer program for generating arpeggio notes, said computer program comprising program instructions which, when read and executed by a computer system, configure the computer system to perform the steps of:

inputting note pitch information which designates pitches of arpeggio constituent notes;

storing track arpeggio patterns including a plurality of track data sets, each of which defines at least generation timings and a tone color of said arpeggio constituent notes; and generating a plurality of notes for a given arpeggio performance based on said inputted note pitch information and at the timings and in a tone color defined by at least two of said stored track arpeggio patterns.

* * * * *